US006944410B2

(12) United States Patent
Naito et al.

(10) Patent No.: US 6,944,410 B2
(45) Date of Patent: Sep. 13, 2005

(54) IMAGE FORMING APPARATUS AND METHOD OF SENSING AMOUNT OF REMAINING DEVELOPER IN IMAGE FORMING APPARATUS

(75) Inventors: Norihito Naito, Shizuoka (JP); Kazumi Yamauchi, Shizuoka (JP); Yasunao Otomo, Shizuoka (JP); Hideaki Hasegawa, Shizuoka (JP); Nobuo Oshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/701,451

(22) Filed: Nov. 6, 2003

(65) Prior Publication Data

US 2004/0105690 A1 Jun. 3, 2004

(30) Foreign Application Priority Data

Nov. 8, 2002 (JP) ..... 2002-325762
Oct. 29, 2003 (JP) ..... 2003-368925

(51) Int. Cl.[7] ..... G03G 15/02; G03G 15/10

(52) U.S. Cl. ..... 399/27; 399/30; 399/61; 399/62

(58) Field of Search ..... 399/27, 29, 30, 399/58, 59, 61, 62, 63; 430/56, 57

(56) References Cited

U.S. PATENT DOCUMENTS

| | | | | |
|---|---|---|---|---|
| 5,581,326 | A | * 12/1996 | Ogata et al. | 399/30 |
| 5,729,787 | A | * 3/1998 | Resch, III | 399/62 |
| 5,802,419 | A | 9/1998 | Sakurai et al. | 399/26 |
| 5,923,917 | A | 7/1999 | Sakurai et al. | 399/27 |
| 6,229,970 | B1 | 5/2001 | Onimura et al. | 399/50 |
| 6,415,112 | B1 | 7/2002 | Kimizuka et al. | 399/27 |
| 6,456,804 | B2 | 9/2002 | Izawa et al. | 399/66 |
| 6,459,861 | B1 | 10/2002 | Sakurai et al. | 399/27 |
| 6,501,916 | B2 | * 12/2002 | Suzuki | 399/30 |

FOREIGN PATENT DOCUMENTS

| | | |
|---|---|---|
| JP | 61-256355 | 11/1986 |
| JP | 2000-206774 | 7/2000 |

* cited by examiner

*Primary Examiner*—Hoang Ngo
(74) *Attorney, Agent, or Firm*—Fitzpatrick, Cella, Harper & Scinto

(57) ABSTRACT

In an image forming apparatus that is capable of forming an image in a plurality of image forming modes that correspond to frequencies of developing bias, a voltage value that reflects the image forming mode and amount of remaining toner is corrected using a correction quantity that conforms to the image forming mode.

19 Claims, 19 Drawing Sheets

IMAGE FORMING APPARATUS AND METHOD OF SENSING AMOUNT OF REMAINING DEVELOPER IN IMAGE FORMING APPARATUS

FIELD OF THE INVENTION

This invention relates generally to an electrophotographic image forming apparatus for forming an electrostatic latent image on an image carrier by an electrophotographic method and visualizing the electrostatic latent image by a developer contained in a developing unit, the developing unit, a process cartridge and a method for sensing the amount of remaining developer contained in a developer container.

BACKGROUND OF THE INVENTION

Conventionally, an electrophotographic image forming apparatus will experience problems in producing an image, such as a decline in image density or loss of image, if the developer (toner) falls short during operation. For this reason the apparatus usually is equipped with means for sensing amount of remaining toner in a developing unit and, when toner runs out, for presenting an indication of this fact to alert the user. The toner may thus be replenished before faulty images are produced. A capacity sensing method is known as one example of means for sensing amount of remaining toner.

Examples of an electrophotographic image forming apparatus include electrophotographic copiers, electrophotographic printers (e.g., LED printers and laser printers, etc.) and electrophotographic facsimile machines. Further, there are two types of process cartridges. In one type, at least one means from among corona discharge means, developing means and cleaning means is integrated with an electrophotographic photosensitive body to form a cartridge and the cartridge is adapted so that it can be installed removably in the main body of the electrophotographic image forming apparatus. In the other type, at least developing means and an electrophotographic photosensitive body are integrated to form a cartridge and the cartridge is adapted so that it can be installed removably in the main body of the electrophotographic image forming apparatus.

FIG. 2 illustrates one example of a developing unit for sensing amount of remaining toner according to the conventional capacity sensing method. As shown in FIG. 2, the developing unit has a developing blade 24, which is a developer regulating member, and a developing sleeve 21, which is a developer carrier. Disposed in the vicinity of the developing sleeve 21 substantially in parallel with the sleeve is a plate antenna PA, which is an electrode for sensing electrical conductivity. Amount of remaining toner is sensed by adopting a change in amount of toner between the developing sleeve 21 and antenna PA as a change in electrostatic capacity. To sense the electrostatic capacity, a developing bias comprising an oscillating voltage obtained by superimposing an AC voltage and a DC voltage is impressed upon the developing sleeve 21 and a current that flows between the plate antenna PA and ground at such time is converted to a DC voltage by a sensing circuit, thereby allowing the current to be read.

An image forming apparatus that has become available in recent years has a plurality of print modes in order to obtain the best image regardless of the type of printing medium (e.g., high-resistance paper such as thick paper), which can be of multifarious types. The setting of developing bias, setting of transfer bias and fixing conditions, etc., are changed over in accordance with the plurality of print modes to obtain a high image quality that conforms to the type of printing medium. In an image forming apparatus of this kind, it is possible to obtain an effective improvement in image quality especially by changing over the frequency of developing bias in the developing bias settings. It should be noted that development is carried out using a developing bias that generally is obtained by superimposing a DC voltage on an AC voltage. The frequency of the developing bias is the frequency of the AC component of the developing bias.

However, in an image forming apparatus having remaining toner sensing means that uses developing bias applied to a developing sleeve as described above, a problem which arises is that the voltage value detected based upon the frequency of the developing bias differs in a case where the frequency of the developing bias is changed over in dependence upon the type of printing medium.

For example, in an arrangement having two print modes conforming to the printing media, assume that the frequency of developing bias in mode 1 is 2.0 kHz and that in mode 2 is 2.4 kHz. FIG. 7 illustrates the relationship between remaining amount of toner and detected voltage in each of these modes.

If output voltage for sensing of remaining amount of toner exceeds 3 V when the frequency of developing bias in mode 1 of the two print modes conforming to the printing media is 2.0 kHz, a faulty image will be produced owing to insufficient toner. Accordingly, if the voltage for rendering a decision to the effect that no toner remains is set to 3 V, a proper decision can be rendered in a case where the frequency of the developing bias is 2.0 kHz. However, in the case of mode 2 where the frequency is 2.4 kHz, the value of 3 V is not attained, image formation is carried out regardless of insufficient toner and, as a consequence, a faulty image is produced.

Conversely, if the voltage for rendering a decision to the effect that no toner remains is set to 2.7 V as the no-toner state at the frequency of 2.4 kHz in mode 2, a no-toner decision will be rendered, despite the fact that much toner remains, in a case where the frequency of the developing bias is 2.0 kHz.

Thus, in a case where image formation is carried out upon changing over the image forming mode by changing the frequency of the developing bias, the output value obtained in sensing amount of remaining toner will differ in dependence upon the frequency of the developing bias that has been set and, consequently, a problem which arises is that the amount of remaining toner cannot be sensed accurately.

In other words, the ability to sense amount of remaining developer accurately irrespective of the frequency of developing bias is required in an electrophotographic image forming apparatus having an image forming mode in which the frequency of an oscillating voltage prevailing at the writing of an image can be changed over in accordance with the type of printing medium.

SUMMARY OF THE INVENTION

Accordingly, an object of the present invention is to make it possible to sense amount of remaining developer accurately.

Another object of the present invention is to make it possible to sense amount of remaining developer accurately irrespective of the frequency of developing bias in an image forming apparatus in which it is possible to set a plurality of developing-bias frequencies in accordance with the type of printing medium at the time of image formation.

An image forming apparatus according to the present invention which achieves above objects having a developing container for accommodating a developer and a developing member for carrying the developer and being capable of setting a plurality of frequencies of developing bias applied to the developing member, the apparatus comprising a sensing member for sensing amount of the developer inside the developing container and a processing unit for obtaining the amount of developer inside the developing container based upon a detection value from the sensing member, wherein the processing unit corrects the detection value in accordance with the frequency of the developing bias and the detection value from the sensing member, and obtains the amount of developer based upon the corrected value.

An image forming apparatus according to another aspect of the present invention having a developing container for accommodating a developer and a developing member for carrying the developer and being capable of setting a plurality of frequencies of developing bias applied to the developing member, the apparatus comprising a first sensing member for sensing amount of the developer inside the developing container and a second sensing member for sensing amount of the developer inside the developing container and a processing unit for obtaining the amount of developer inside the developing container based upon the frequency of the developing bias and a first detection value from the first sensing member or a second detection value from the second sensing member.

An image forming apparatus according to the present invention which achieves above objects having a developing container for accommodating a developer and a developing member for carrying the developer and being capable of setting a plurality of frequencies of developing bias applied to the developing member, the apparatus comprising a sensing member for sensing amount of the developer inside the developing container and a processing unit for obtaining the amount of developer inside the developing container based upon a detection value from the sensing member, wherein the processing unit corrects the detection value in accordance with the frequency of the developing bias, and obtains the amount of developer based upon the corrected values.

A method of sensing amount of developer in an image forming apparatus according to the present invention having a developing container for accommodating a developer and a developing member for carrying the developer and being capable of setting a plurality of frequencies of developing bias applied to the developing member, said method comprising the steps of sensing a detection value from a sensing member for sensing amount of the developer inside the developing container, correcting the detection value in accordance with the frequency of the developing bias and the detection value and obtaining the amount of developer inside the developing container based upon the corrected value.

A method of sensing amount of developer in an image forming apparatus according to another aspect of the present invention having a developing container for accommodating a developer and a developing member for carrying the developer and being capable of setting a plurality of frequencies of developing bias applied to the developing member, said method comprising the steps of sensing a first detection value from a first sensing member for sensing amount of the developer inside the developing container, sensing a second detection value from a second sensing member for sensing amount of the developer inside the developing container and obtaining the amount of developer inside the developing container based upon the frequency of the developing bias and the first detection value or the second detection value.

A method of sensing amount of developer in an image forming apparatus according to another aspect of the present invention having a developing container for accommodating a developer and a developing member for carrying the developer and being capable of setting a plurality of frequencies of developing bias applied to the developing member in accordance with the type of a printing medium used in image formation, said method comprising the steps of sensing a detection value from a sensing member for sensing amount of the developer inside the developing container, correcting the detection value in accordance with the frequency of the developing bias and obtaining the amount of developer inside the developing container based upon the corrected value.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

[First Embodiment]

Figure 8:
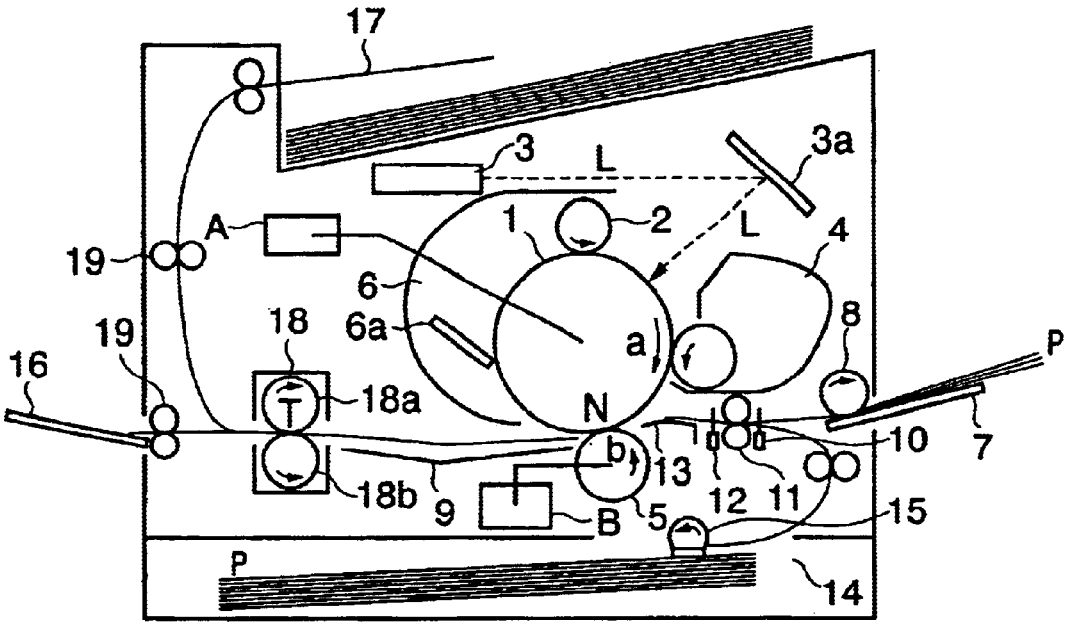
FIG. 8 is a diagram illustrating an example of the cross section of the main body of an image forming apparatus corresponding to the first embodiment of the present invention.

FIG. 8 is a schematic sectional view of an image forming apparatus to which the present invention is applied. A photosensitive drum 1 serving as an image carrier in FIG. 8 comprises a photosensitive material such as OPC or amorphous silicon and a cylindrical substrate made of aluminum or nickel, etc., on which the photosensitive material has been formed. The photosensitive drum 1 is driven rotatively by drive means A at a prescribed speed in the clockwise direction a, which is indicated by the arrow. Charging means 2 charges the periphery of the rotating photosensitive drum 1 uniformly to a prescribed polarity and potential. A contact-type charging device employing a charging roller is used in this example.

Image information exposure means 3 uses a laser-beam scanner in this embodiment. The scanner 3, which has a semiconductor laser, a polygon mirror and an F-θ lens, etc., emits a laser beam L, which is controlled so as to be turned on and off in accordance with image information that has been sent from a host device (not shown), and causes the laser beam L to be scanned across the uniformly charged surface of the photosensitive drum 1 to thereby form an electrostatic latent image.

A developing unit 4 constructs a process cartridge and develops the electrostatic latent image on the photosensitive drum 1 as a toner image. A jumping developing method or a two-component developing method, etc., is used as the developing method, and often use is made of a combination of image exposure and reversal development.

A transfer roller 5 serves as a contact charging member having the shape of a rotary body equipped with a resilient layer. The transfer roller 5 is brought into pressured contact with the photosensitive drum 1 to form a transfer nip N and is driven rotatively by drive means B at a prescribed speed in the clockwise direction b, which is indicated by the arrow. Toner images that have been formed on the photosensitive drum 1 are successively transferred electrostatically to a printing medium (transfer medium) P fed to the transfer nip N from a feeder.

The printing medium P fed from the feeder such as a manual-insertion feeder 7 or cassette feeder 14 stands by at a prefeed sensor 10 and then is fed to the transfer nip N (the image forming section) upon traversing registration rollers 11, a registration sensor 12 and a pre-transfer guide 13. The printing medium P is synchronized by the registration sensor 12 with the toner image that has been formed on the surface of the photosensitive drum 1, and the printing medium P is supplied to the transfer nip N formed by the photosensitive drum 1 and transfer roller 5.

Separation rollers 8, 15 are provided in order to eliminate feed of overlapping sheets that occurs when a plurality of sheets of the printing medium P are fed at one time at the feeder. The sheet of printing medium P that has received transfer of the toner image at the transfer nip N then traverses the transfer nip N, is separated from the surface of the photosensitive drum 1 and is then transported to a fixing device 18 via a sheet path 9.

The fixing device 18 in this example is a film-heating-type fixing unit comprising a heating film unit 18*a* and a pressurizing roller 18*b*. The printing medium P having the toner image is embraced and transported by the heating film unit 18*a* and a fixing nip T, which is the pressure-contact portion of the pressurizing roller 18*b*, thereby being heated and pressurized so that the toner image is fixed to the printing medium P as a permanent image. The printing medium P on which the toner image has been fixed is ejected either face up 16 or face down 17 in accordance with ejection rollers 19.

The surface of the photosensitive drum 1 after transfer of the toner image to the printing medium P has residual toner removed by a cleaning device 6 of the process cartridge, thereby cleaning the surface so that the photosensitive drum 1 may be used for image formation repeatedly. The cleaning device 6 of this embodiment is a blade-type cleaning device having a cleaning blade 6*a*.

Figure 2:
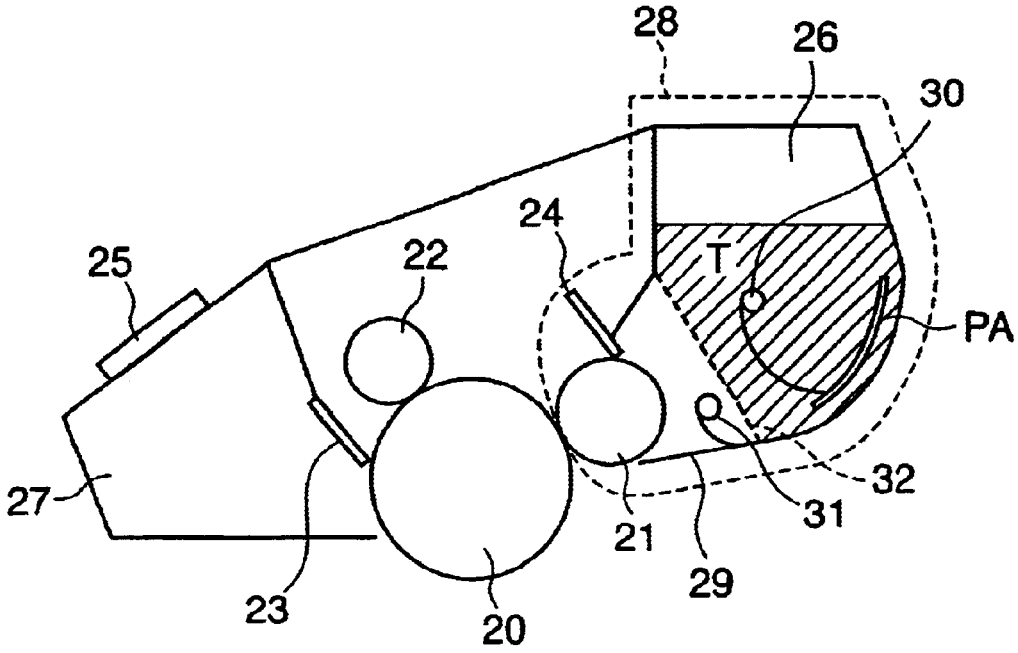
FIG. 2 is a diagram illustrating an example of the cross section of a toner cartridge corresponding to the first embodiment of the present invention.

Reference will be had to FIG. 2 to describe the details of the process cartridge of the present invention. The electrophotographic image forming apparatus used in the present invention is a laser printer that accepts image information from a host computer and outputs the information as a visible image. This is an image forming apparatus in which such consumables as the electrophotographic photosensitive body, developing means and developer (toner) can be exchanged by being installed removably in the main body of the apparatus as a process cartridge.

As shown in FIG. 2, the process cartridge (referred to simply as a "cartridge" below) is obtained by integrating a photosensitive drum 20 serving as an electrophotographic photosensitive body; a charging roller 22 serving as charging means for uniformly charging the photosensitive drum 20; a developing device 28; a cleaning blade 23 serving as cleaning means for cleaning off the surface of the photosensitive drum 20; and a waste toner container 27 for accommodating residual toner that has been removed from the photosensitive drum 20 by the cleaning blade 23. The cartridge thus constructed can be removably installed in the main body of the image forming apparatus (referred to simply as the "apparatus body" below).

The developing device 28 includes a toner container 26, which is a developer container for accommodating toner T serving as the developer; a developing vessel 29 connected to the toner container 26; the developing blade 24, which is a developer regulating member that comes into contact with the developing sleeve 21 to regulate the thickness of the toner layer; a toner-container stirring member 30 for stirring the toner T inside the toner container 26 and feeding the toner T into the developing vessel; and a stirring member 31 for transporting the toner T, which has been fed in from the toner container, to the developing sleeve 21.

A toner sealing member 32 is affixed between the toner container 26 and developing vessel 29 before the cartridge is used. The toner sealing member 32 is provided in such a manner that toner will not leak even in a case where a severe impact is sustained during transport of the cartridge. The toner sealing member 32 is unsealed by the user before the cartridge is mounted in the apparatus body.

In the arrangement described above, the photosensitive drum is charged uniformly by the charging roller 22 and the surface thereof is scanned and exposed by the laser beam emitted by the laser scanner, thereby forming an electrostatic latent image of the desired image information. The electrostatic latent image is visualized as a toner image as a result of fixation of the toner by the action of the developing roller, etc.

In this embodiment, an insulative magnetic single-component toner is used as the developer. The laser printer according to this embodiment has developer sensing means capable of successively sensing the amount of remaining toner as the developer (toner) is expended.

In this embodiment, as shown in FIG. 2, the developer sensing means is so constructed that the electrode (plate antenna) PA is placed opposite the developing sleeve 21 via the toner T so as to form a capacitor structure within the toner container. Thus, use is made of a plate-antenna toner sensor in which the toner is accommodated by the plate antenna PA disposed opposite the developing sleeve 21 via the toner T.

Further, the cartridge of this embodiment has a memory unit 25. The memory unit 25 stores image formation process settings necessary for image formation, such as a charging bias setting value, a developing bias setting value and a light-quantity setting value relating to the laser serving as the exposure means, and amounts of use such as amount of use of the photosensitive body and amount of remaining toner. The memory unit 25 can be implemented by an EPROM or EEPROM, by way of example.

In particular, a remaining-toner level, which is information indicating the number of remaining pages that can be printed by the cartridge, is stored in the memory to present the user with information representing the number of pages for which the cartridge can be used, or is used as an indicator for performing optimum image formation conforming to history of use.

Figure 3:
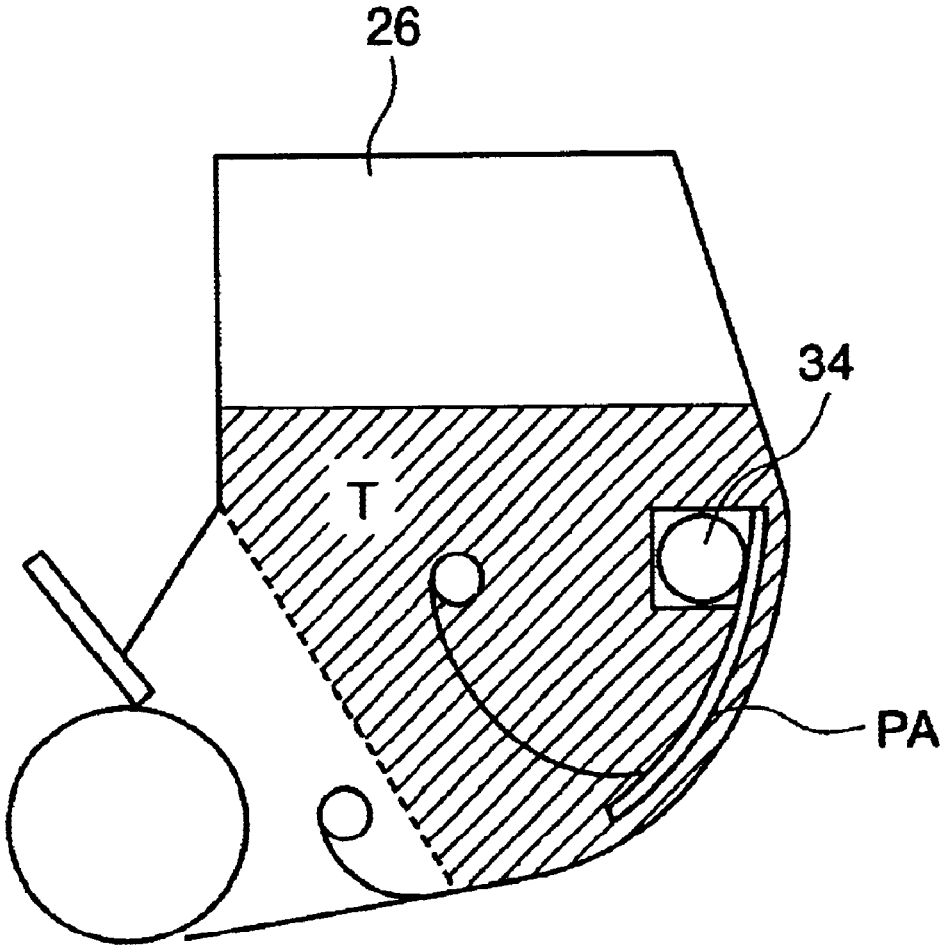
FIG. 3 is a diagram illustrating an example of the cross section of a developing unit corresponding to the first embodiment of the present invention.

FIG. 3 is a diagram illustrating the structure of the developing device 28 according to this embodiment. The toner T in the toner container 26 is a fluid-like substance. As shown in FIG. 3, the plate antenna PA is disposed within the toner container 26 in such a manner that the degree of decrease in toner T can be directly ascertained. As long as the plate antenna PA is a plate-shaped member that is a good conductor, any material may be used as the plate antenna PA. However, in a case where the plate antenna PA is placed inside the toner cartridge, it is desired that the antenna material be such that the toner particles will not be adversely affected. It is also preferred that the material be strongly resistant to such environmental conditions as humidity.

At least the side face of the plate antenna PA is formed to have a shape that allows it to be electrified from the outside. The connection to the plate antenna PA may be a direct connection such as a conducting wire. Alternatively, the cartridge side face may be provided with a conductive pin-type configuration that is connected by being plugged in. According to this embodiment, the arrangement is such that the pin-like configuration is thrust into a pull-out 34 via the side wall of the cartridge.

Sensing of amount of remaining toner by the developing sleeve 21 and plate antenna PA is carried out by measuring the amount of remaining toner using a developing bias applied to the developing sleeve 21. More specifically, the value of voltage induced by the plate antenna PA is sensed by the developing via applied to the developing sleeve 21. If the dielectric constant differs in accordance with the amount of remaining toner between the developing sleeve 21 and plate antenna PA, the voltage value induced by the plate antenna PA will differ. Accordingly, the remaining-toner level can be sensed based upon the differing voltage value.

The apparatus body and the cartridge are provided with electrical contacts (not shown). The plate antenna PA of the cartridge and the remaining-toner sensing portion (not shown) inside the apparatus body are electrically connected through these electrical contacts when the cartridge is mounted in the apparatus body.

Figure 1A:
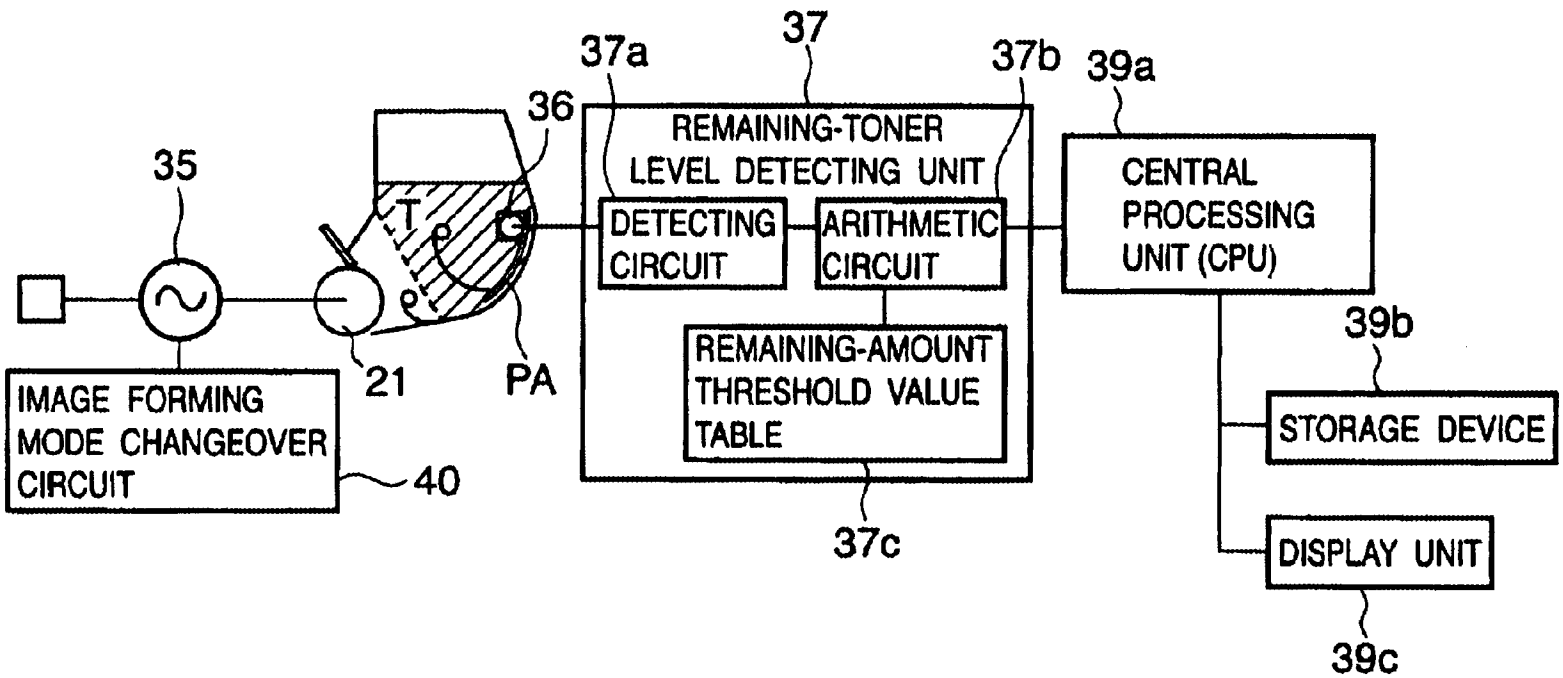
FIG. 1A is a block diagram illustrating a circuit for sensing amount of remaining toner according to the prior art.

FIG. 1A illustrates the circuit arrangement of the remaining-toner level sensing portion when the cartridge has been mounted in the apparatus body.

When a prescribed AC bias is output from a developing bias circuit 35 serving as means for applying a developing bias in FIG. 1A, the applied bias is impressed upon the developing sleeve 21. A value of voltage produced in accordance with the electrostatic capacity of an electrode pattern on the plate antenna PA is output from an electrode 36 to a remaining-toner level detecting unit 37. The latter has a detecting circuit 37*a* that converts the voltage value to a digital voltage value (this value shall be referred to as a "remaining-toner detection output value" below), and an arithmetic circuit 37*b* for comparing the digital voltage value with a threshold value that has been stored in a remaining-amount threshold value table 37*c*. The result of comparison is transmitted to a CPU 39*a* and stored temporarily in a storage device 39*b* as the remaining-toner level. [The amount of toner remaining in a case where 100 stands for the amount of toner available at the start of use is represented by a percentage. At the start of use, therefore, the amount of toner is 100(%). If half the toner remains, this is represented by 50(%), and if no toner remains, then this is represented by 0(%).] By way of example, the result of the comparison is reported to the user via a display unit 39*c* as a "%" indication of amount of remaining toner or in the form of number of remaining pages that can be printed.

Further, in a case where the apparatus possesses a plurality of developing biases, a circuit 40 for changing over the image forming mode outputs a changeover command so that an output conforming to the image forming mode will be delivered from the developing bias circuit 35.

In general, the developing bias used in sensing amount of remaining toner is set to a value for which the best image quality will be obtained regardless of the type of printing medium. However, with a diversification of types of printing medium in the future, there may be cases where, depending upon the type of printing medium, the best image quality is not obtained using a single setting of developing bias or a single setting of transfer bias.

Figure 4C:
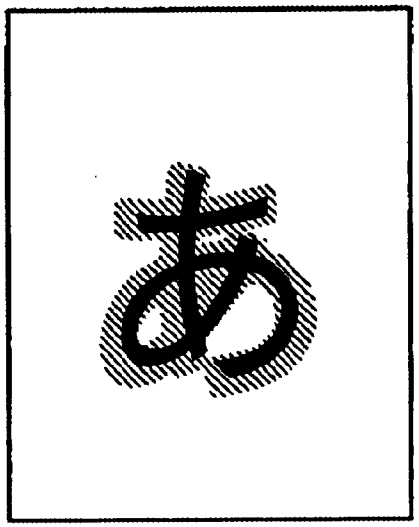
FIGS. 4A to 4C are schematic views illustrating examples of faulty images corresponding to the first embodiment of the present invention.
Figure 4B:
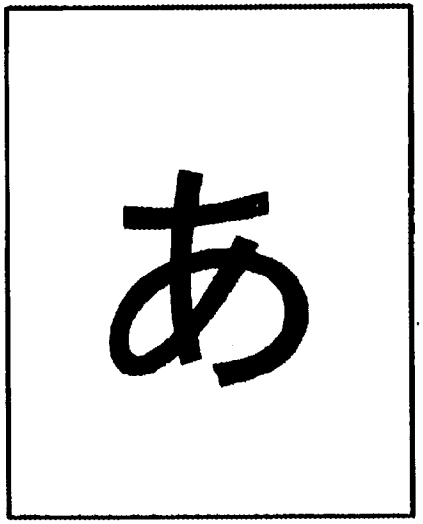
Figure 4A:
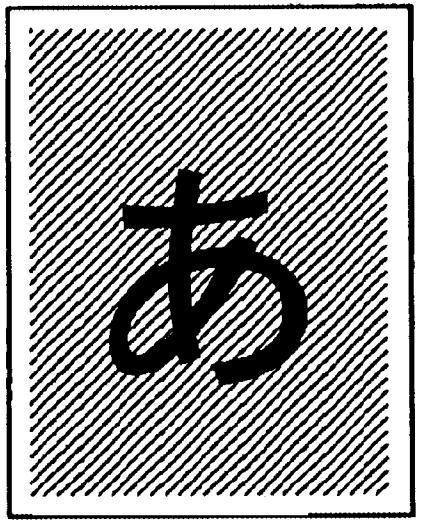

In particular, if the setting of developing bias departs from a setting for which the best image quality can be acquired for the printing medium, problems arise and a normal image in FIG. 4B will not be obtained. Specifically, fogging may occur as at in FIG. 4A, where toner scatters into a white area where image formation should not take place, or blurring may occur as at in FIG. 4C, where the boundary between the white area and the area in which image formation should take place becomes blurred. The problem of fogging and blurring occurs often particularly in printing media that are used comparatively infrequently, examples of such media being thick paper and high-resistance printing media.

When a toner image is developed on a photosensitive drum, some toner usually scatters into white areas where a toner image should not be developed. This occurs because the amount of electric charge on the toner per se is small. However, even if toner is dispersed into an area on the photosensitive drum that corresponds to a white area on the printing medium, the thick printing medium that is usually employed is such that toner charged only to a small amount of electric charge will not readily be transferred from the photosensitive drum to the printing medium by the transfer voltage. The toner remains on the photosensitive drum and is eventually cleaned off and collected in a toner recovery vessel.

In the case of thick paper or a high-resistance printing medium, the pressure that brings the paper or medium into contact with the photosensitive drum is greater than in the case of plain paper. Accordingly, toner on the drum and toner having a small amount of electric charge is transferred to white areas of the printing paper by pressure and a large quantity of the toner attaches itself. This tends to produce fogging. There are cases where blurring also occurs. To suppress the amount of toner of little electric charge that is dispersed into white areas on the photosensitive drum in order that fogging and blurring may be avoided, it is necessary to set a high developing-bias frequency in the case of thick paper or a high-resistance printing medium.

Thus, the image defects of fogging and blurring can be eliminated by enlarging the value of developing-bias frequency. On the other hand, if a biasing-voltage setting that is for obtaining the best image quality with thick paper is applied also to a frequently used printing medium such as plain paper, there may be cases where characters and lines become extremely slender and tonality deteriorates.

Accordingly, in order to eliminate the problem of decline in image quality ascribable to fogging and blurring, it is required that a special image forming mode be provided in addition to the image forming modes for setting frequency for high-quality printing on paper from the usually employed plain paper, which has a weight of 60 g/m$^2$ or 80 g/m$^2$, to thick paper having a weight on the order of 200 g/m$^2$. The special image forming mode sets a frequency of developing bias that will not cause fogging or blurring on printing media or high-resistance paper having a weight greater than 200 g/m$^2$.

However, in a case where frequencies of a plurality of developing biases are provided in accordance with the image forming modes, a deviation develops in the output value of detecting circuit 37*a*, which senses the amount of remaining toner by using developing bias. As a consequence, there is a marked decline in the accuracy with which the remaining-toner level is discriminated.

Accordingly, in case of selection of an infrequently used frequency employed with thick paper or high-resistance paper, it is possible to adopt a measure such as refraining from the sensing of amount of remaining toner. However, if an infrequently employed frequency continues to be used, it will be difficult to furnish a satisfactory result of residual toner detection.

Further, special-purpose circuits having threshold-value tables conforming to respective ones of the frequencies of developing bias for the purpose of deciding the remaining-toner level may be provided in a number equivalent to the number of frequencies of developing bias. However, this is a difficult option in view of the area needed for circuit installation and the problem of cost.

According to the present invention, therefore, a correction is applied to a remaining-toner detection output value, which is obtained by sensing amount of remaining toner, in accordance with the frequency of developing bias of each of a plurality of image forming modes, whereby there is obtained a constant output regardless of the frequency of developing bias.

The image forming apparatus according to this embodiment will now be described further. In this embodiment, the paper feed rate is assumed to be 30 ppm, which means that 30 sheets of paper can be fed continuously in one minute. Further, it is assumed that the interval between sheets at the time of continuous feed is about 0.5 s, and that warm-up time from the moment a print command is received from the host machine to the start of printing is 10 s. Furthermore, it is assumed that fall time for executing end processing at the end of printing is 5 s. The interior of the cartridge is provided with a stirring blade for circulating the toner within the container, and the rotational speed of the stirring blade is set to 10 rpm so as to achieve dynamic circulation of the toner within the container.

A PET (polyethylene terephthalate) sheet having a thickness of 0.5 mm is used for the stirring blade in this embodiment in order to obtain a suitable composition. It is assumed that the amount of toner accommodated within the toner container is 100 g when the container is full. Similarly, the interior of the cartridge is provided with a plate antenna for measuring the amount of remaining toner and an adjustment is made within the cartridge container so that the electrostatic capacity will be 2 pF in the absence of toner and 6 pF when the cartridge is full of toner.

Further, it is assumed that the frequency component of the developing bias is 2.0 kHz in a case where use is made of a frequently used printing medium, and this frequency is adopted as the reference frequency in this embodiment. In addition, the circuitry is so adapted that 3 V will be obtained as the remaining-toner detection output value in case of 2 pF, which prevails in the absence of toner, and 2 V in case of 6 pF, which prevails when the cartridge is full of toner.

The above-mentioned settings relating to operating conditions are adopted as one example for the description that follows, and the present invention is not limited to one implemented under the above-mentioned conditions. The technical idea characterizing the present invention described below is applicable to various operating conditions set when working the present invention.

Described first will be a case where a plurality of frequencies of developing bias are provided inclusive of the reference frequency and amount of remaining toner is sensed without applying a correction.

Figure 5:
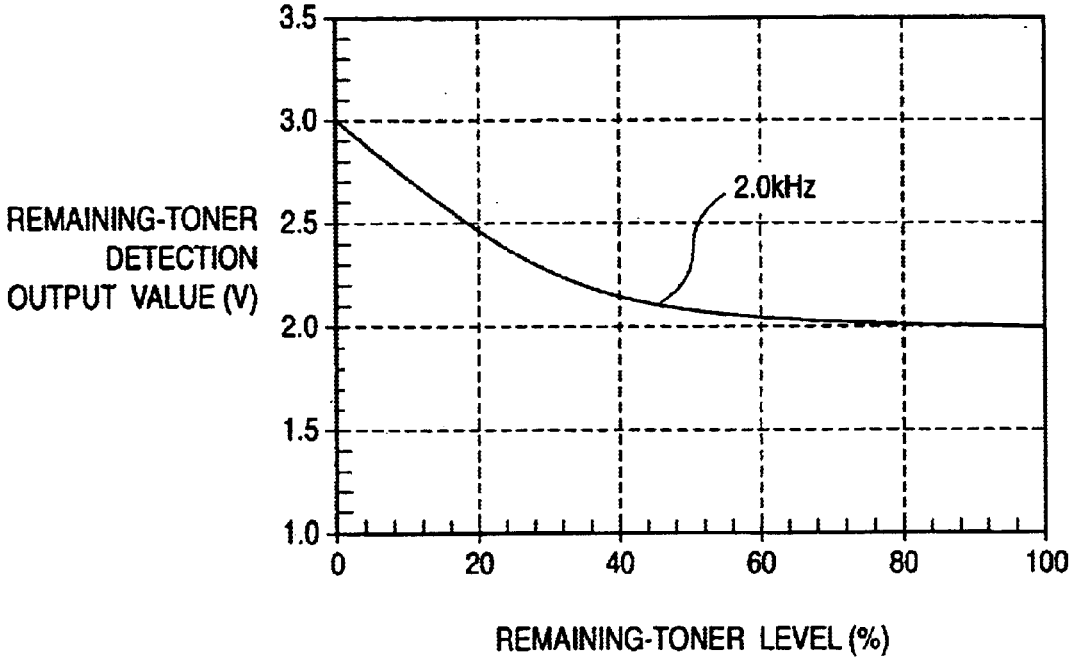
FIG. 5 is a diagram illustrating an output obtained in sensing amount of remaining toner at a frequency of developing bias of 2.0 kHz corresponding to the first embodiment of the present invention.

FIG. 5 illustrates the transition of the remaining-toner detection output value over a period of time from a toner-full container to a toner-empty container at a frequency of developing bias of 2.0 kHz based upon the arrangement described above. It will be understood that the output voltage changes gradually as the amount of toner decreases. More specifically, the remaining-toner detection output value is 2.0 V at a remaining-toner quantity of 50%, 2.36 V at a remaining-toner quantity of 50% and 3.0 V at a remaining-toner quantity of 0%. For example, it can be set up such that if the remaining-toner level has been sensed, the user is provided with a display or warning of the amount of remaining toner via the display unit 39*c*.

Figure 6:
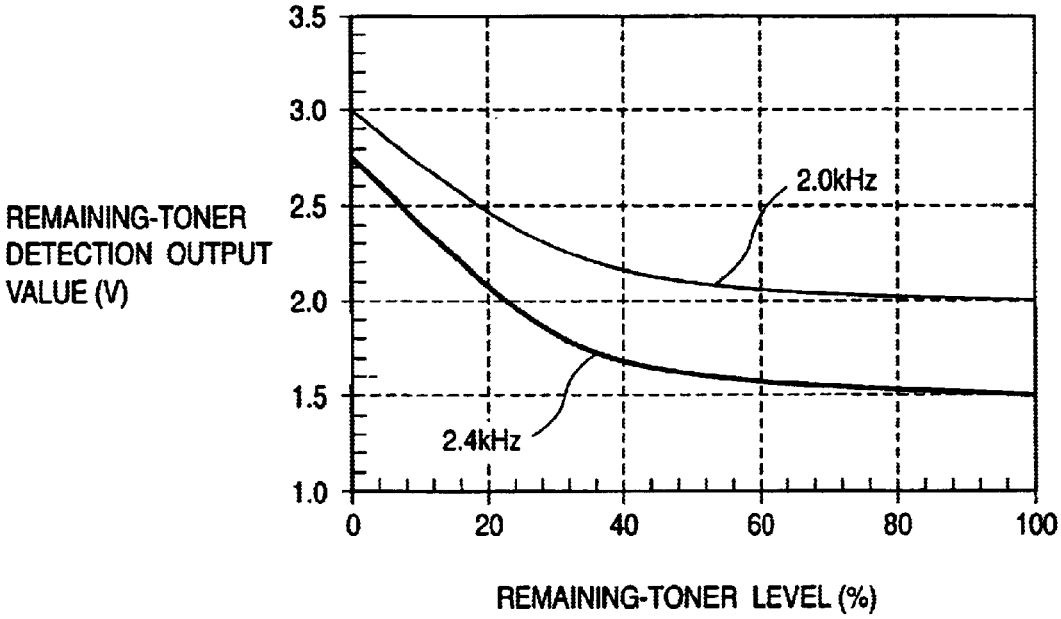
FIG. 6 is a diagram illustrating output values obtained in sensing amount of remaining toner at frequencies of developing bias of 2.0 kHz and 2.4 kHz corresponding to the first embodiment of the present invention.

Similarly, consider a transition of the remaining-toner detection output value in a case where the frequency of developing bias is assumed to be 2.4 kHz. The frequency of 2.4 kHz is one example of a frequency considered to be free of the problems of fogging and blurring in the case of thick paper or high-resistance paper. This is the frequency of developing bias adopted to describe this embodiment; it does not impose a limitation upon the invention and can be changed at will. FIG. 6 is the result of superimposing this transition on that of FIG. 5. It will be understood that the transition of the remaining-toner detection output value has undergone a large shift. Accordingly, if the remaining-toner level has been decided based upon the remaining-toner detection output at a frequency of developing bias that is the reference frequency (2.0 kHz) in a case where the frequency of developing bias has been set to 2.4 kHz, a large disparity of the kind indicated in Table 1 below will occur between the decided level of remaining amount of toner and the actual level of remaining amount of toner. Table 1 indicates the actual amount of remaining toner in terms of percentages in a case where remaining-toner levels reported to the user are 50%, 25% and 0% when frequency of developing bias is set to either of two values, namely 2.0 and 2.4 kHz.

TABLE 1

| | 50% | 25% | 0% | |
|---|---|---|---|---|
| 2.0 kHz | 50 | 25 | 0 | |
| 2.4 kHz | 19 | 11 | — | (%) |

Table 1 indicates that if a correction conforming to the changeover in the setting is not performed in a case where a plurality of frequencies of developing bias are capable of being set, notification to the user that the amount of remaining toner is 50% is issued when the actual amount of remaining toner is really less than 20%. Thus there is a major decline in accuracy that can invite a misunderstanding on the part of the user.

Accordingly, this embodiment is such that in a case where the frequency of developing bias is 2.4 kHz, a correction of 0.45 V is applied to the remaining-toner detection output value based upon the difference between the frequencies of developing bias of 2.0 and 2.4 kHz in FIG. 6.

For example, consider an instance where the amount of remaining toner is 50% in FIG. 6. At the moment the remaining-toner level reaches 50%, the output value at the frequency of developing bias of 2.0 kHz is 2.1 V. If the frequency of developing bias is made 2.4 kHz, however, the voltage value becomes 1.63 V. Accordingly, when the frequency of developing bias is 2.4 kHz, a correction quantity of 0.45V is applied to the output value of 1.63 V.

Figure 7:
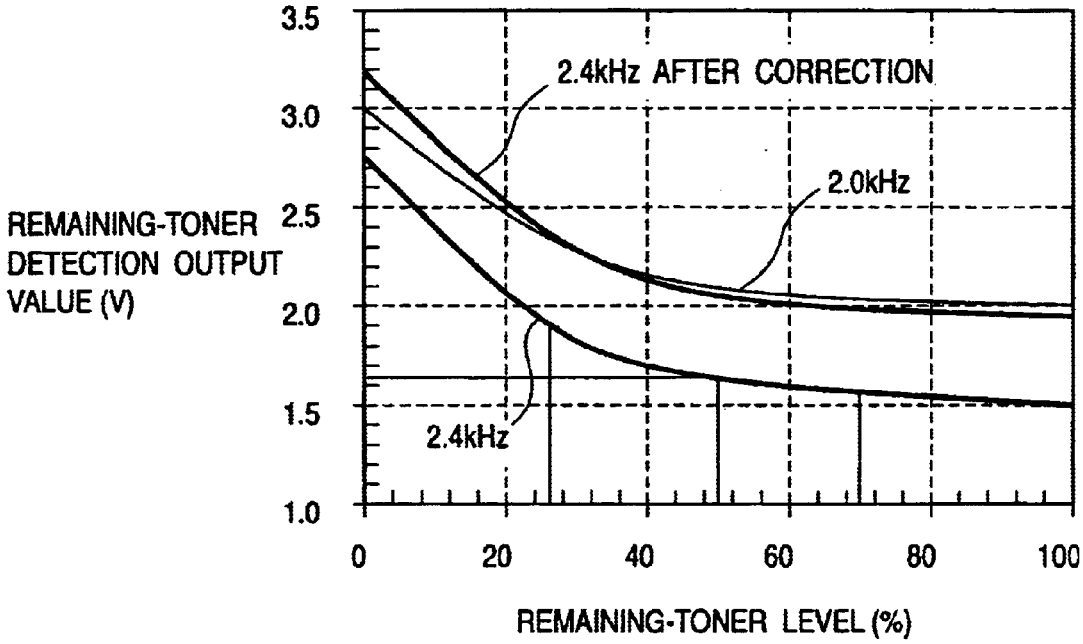
FIG. 7 is a diagram useful in describing correction of output values obtained in sensing amount of remaining toner corresponding to the first embodiment of the present invention.

If this is done, the output value after the correction will be 2.08 V in a case where the frequency of developing bias is 2.4 kHz, and therefore it is possible to achieve a correction that is very close to the output value of 2.1 V that prevails when the frequency of developing bias is 2.0 kHz. FIG. 7 illustrates a case where a correction has been applied to the overall transition. The transition obtained after the correction is very close to the transition for when the frequency of developing bias is 2.0 kHz.

Further, remaining-toner detection output values obtained when the correction has been applied are as shown in Table 2 below. Even if the arrangement is such that the apparatus has frequencies of developing bias of 2.0 and 2.4 kHz, accuracy can be maintained by applying a proper correction to the output value. Table 2 indicates the actual remaining-toner levels, as well as the remaining-toner levels after correction in an instance where the frequency of developing bias has been set to 2.4 kHz, in a case where remaining-toner levels reported to the user are 50%, 25% and 0% when frequency of developing bias is set to either of two values, namely 2.0 and 2.4 kHz.

TABLE 2

| | 50% | 25% | 0% | |
|---|---|---|---|---|
| 2.0 kHz | 50 | 25 | 0 | |
| 2.4 kHz | 19 | 11 | — | |
| AFTER CORRECTION | 45 | 27 | 6 | (%) |

Figure 1B:
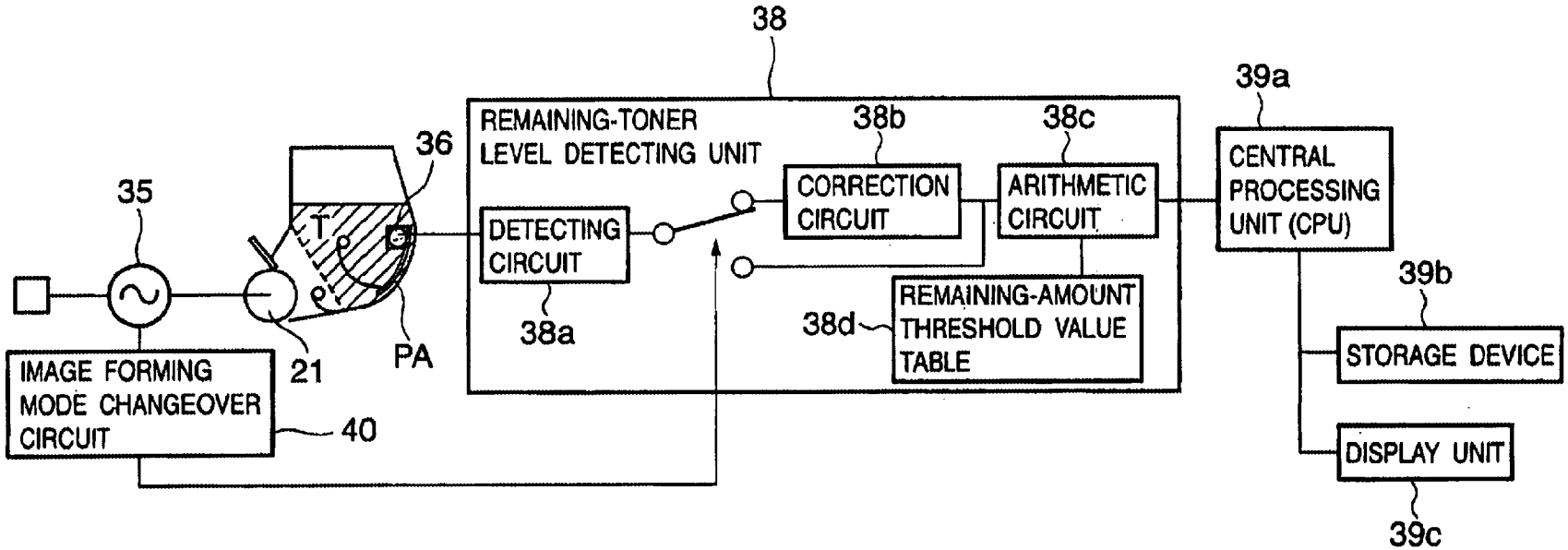
FIG. 1B is a block diagram illustrating a circuit for sensing amount of remaining toner corresponding to the first embodiment of the present invention.

FIG. 1B illustrates circuitry for applying the above-described correction to a remaining-toner detection output value. Here the structure of the remaining-toner level detecting unit differs from that of the prior art. In FIG. 1B, the voltage value produced in accordance with the electrostatic capacity of the electrode pattern on the plate antenna PA is output from the electrode 36 to a remaining-toner level detecting unit 38. The latter has a detecting circuit 38*a* that converts the voltage value to a digital voltage value and outputs a remaining-toner detection output value. In accordance with the output of the circuit 40 for changing over the image forming mode, the remaining-toner detection output value is input to an arithmetic circuit 38*c* after being corrected in a correction circuit 38*b* or is input to the arithmetic circuit 38*c* directly upon bypassing the correction circuit 38*b*. The arithmetic circuit 38*c* compares the corrected or uncorrected remaining-toner detection output value input thereto with a threshold value that has been stored in a remaining-amount threshold value table 38*d*, decides the remaining-toner level and transmits the decided remaining-toner level to the CPU 39*a*.

Figure 15:
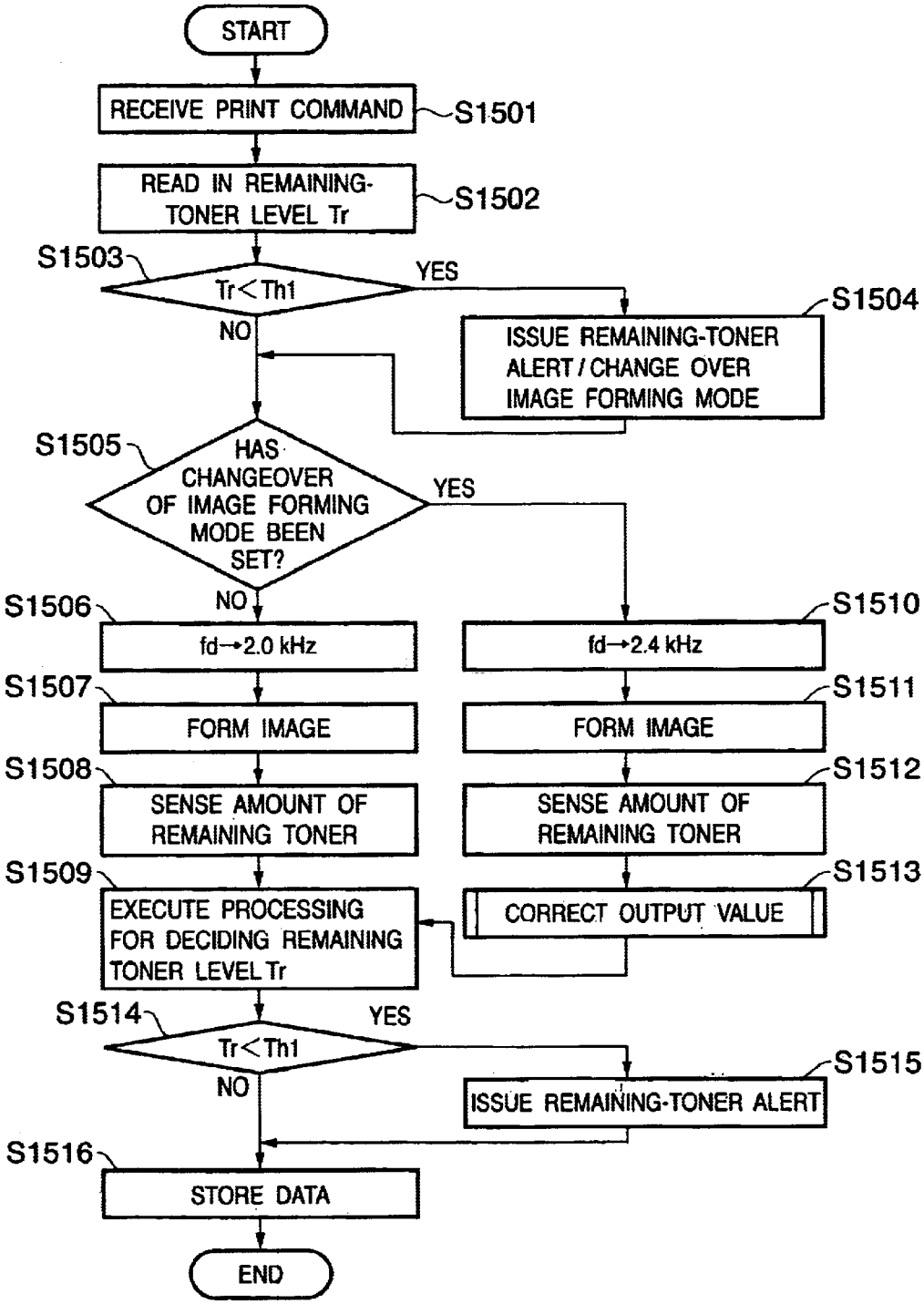
FIG. 15 is a flowchart relating to processing for sensing amount of remaining toner corresponding to the first embodiment of the present invention.

The operation of this embodiment will be described with reference to FIG. 15. First, if a print command from the user is received at step S1501 in FIG. 15, the present remaining-toner level that has been stored in the memory unit 25 attached to the cartridge or in the storage device 39*b* of the printer body is read in at step S1502. If it is determined at step S1503 that the amount of remaining toner has become extremely low (e.g., if it is found that Tr<Th1 holds, where Tr represents the remaining-toner level and Th1 a threshold value for discriminating the remaining-toner level), then an alert indication to the effect that the amount of remaining toner has decreased is presented to the user at step S1504. At this time the threshold value Th1 can be set to a level of 50% or 25%, by way of example. As for the content of the alert presented to the user, the remaining-toner level may be displayed as a numerical value (e.g., the remaining 20%), or a specific act to be performed may be indicated as by a message reading "TONER SHOULD BE REPLACED SOON" or "REPLACE TONER".

A setting for changing over the image forming mode may also be performed at step S1504 together with the issuance of the alert to the user. That is, deterioration of the developer or deterioration of the members surrounding the developing unit may accelerate with a printing medium that is a frequently used medium for which maximum image quality is obtained using, e.g., 2.0 kHz. (The degree of deterioration can be estimated from the remaining-toner level.) In such case a better image quality will be obtained if the frequency of developing bias is made 2.4 kHz instead. Thus, changing over the image forming mode is useful in this case as well.

Next, it is determined at step S1505 whether a setting for changing over the image forming mode has been made. The setting to change over the image forming mode involves two cases, namely a case where the setting is made in accordance with a command from the user and a case where the setting is made automatically in dependence upon the type of printing medium P fed from the feeder or the amount of remaining toner.

If it is determined at step S1505 that the changeover setting has not been made, control proceeds to step S1506, where the frequency of developing bias (fd) is set to 2.0 kHz, and then the image forming operation is performed at step S1507 without changing over the image forming mode. Next, at step S1508, the amount of remaining toner at the frequency of developing bias of 2.0 kHz is sensed and output as the remaining-toner detection output value. The remaining-toner level is decided at step S1509 based upon the remaining-toner detection output value obtained.

If it is determined at step S1505 that the changeover setting has been made, control proceeds to step S1510, where the frequency of developing bias (fd) is set to 2.4 kHz, and then the image forming operation is performed at step S1511 upon changing over the image forming mode. At the same time the image forming operation is carried out, the amount of remaining toner at the frequency of developing bias of 2.4 kHz is sensed at step S1512. The output-value correction is applied at step S1513 to the remaining-toner detection output value that was obtained as the value indicative of amount of remaining toner. The remaining-toner level is decided at step S1509 based upon the remaining-toner detection output value prevailing after the correction.

As a result of the above, it is determined at step S1514 whether the remaining-toner level (Tr) has fallen below the predetermined level (Th1). If the result of this determination is that the amount of remaining toner is too small ("YES" at step S1514), then the user is alerted of the fact that the amount of remaining toner is very low, as by indicating this fact on the comparator 39*c*, at step S1515 (an example of the content of this alert is similar to that of step S1504). If the amount of remaining toner is equal to or greater than the fixed level, or after the alert concerning amount of remaining toner has been issued, such data as information concerning the amount of remaining toner and paper-feed history information is stored in the memory unit 25 and storage device 39*b* at step S1516. Processing is then exited.

Thus, as set forth in this embodiment, in a case where a change is made to any of a plurality of frequencies of developing bias depending upon the type of printing medium, a remaining-toner detection output value is corrected utilizing a correction value corresponding to the particular frequency among these frequencies of developing bias, thereby making it possible to furnish the maximum image quality regardless of the type of printing medium while maintaining the accuracy with which the amount of remaining toner is sensed.

The above embodiment has been described with regard to frequencies of developing bias of two values, namely 2.0 and 2.4 kHz. However, these settings of frequency of developing bias are exemplary only and do not impose any limitation. Further, it is not intended that the invention of this application necessarily be worked at these two frequencies. Further, the above description has been rendered with regard to an arrangement having two types of frequencies of developing bias. However, in a case where a greater number of frequencies of developing bias are utilized, effects similar to those set forth above can be obtained by applying a correction conforming to each set frequency to the remaining-toner detection output value.

Further, the image forming mode (frequency of developing bias) may be changed over not only in dependence upon the type of printing medium. By taking into consideration acceleration of the deterioration of the developer or deterioration of the members surrounding the developing unit, the image forming mode can be changed over in a case where the amount of remaining toner has become small, as mentioned earlier.

In this embodiment, the image forming mode for obtaining the best image quality has been described in regard to a change in frequency of developing bias. However, this does not impose any limitation and it is efficacious to combine a method of changing resolution or a method of changing process speed with the change of frequency of developing bias in order to obtain an image of high-definition quality.

[Second Embodiment]

The invention corresponding to the first embodiment corrects the output value representing the sensed amount of remaining toner by utilizing a correction quantity conforming to the frequency of developing bias, thereby making it possible to raise the accuracy with which the amount of remaining toner is sensed. However, as will be understood from FIG. 7, the disparity in frequency of developing bias cannot be compensated for completely because a difference arises also in the amount of change in output from the state in which the vessel is full of toner to the state in which the vessel is empty owing to the change in frequency of developing bias in a case where the correction is applied uniformly to remaining-toner detection output values.

Further, even though the optimum correction is applied in the first embodiment, the fact that some deviation occurs in comparison with the remaining-toner level at 2.0 kHz, as indicated in Table 2, is ascribable to the difference in amount of change in the remaining-toner detection output.

Accordingly, this embodiment is characterized in that in a case where a correction of the remaining-toner detection output value is applied using a correction quantity conforming to the frequency of developing bias, as in the first embodiment, use is made of a correction quantity having a value conforming to the amount of remaining toner in addition to the frequency of developing bias.

Aspects of the second embodiment that duplicate those of the first embodiment will be omitted from the description rendered below. In addition, the condition settings of the first embodiment relating to detection of the remaining-toner level will be adopted in the second embodiment as well. Accordingly, the correction quantity for the frequency of 4.2 kHz attendant upon the amount of remaining toner is set as shown in Table 3 based upon FIG. 7. Table 3 indicates the correction quantity, which is applied to the remaining-toner detection output value, conforming to the remaining-toner detection output value at the frequency of developing bias of 2.4 kHz.

TABLE 3

| | 1.55~1.50 | 1.65~1.55 | 1.90~1.65 | 2.20~1.90 | 2.55~2.20 | 2.75~2.55 | (V) |
|---|---|---|---|---|---|---|---|
| CORRECTION QUANTITY AT 2.4 kHz | 0.50 | 0.48 | 0.42 | 0.36 | 0.30 | 0.25 | (V) |

Here an optimum correction is applied, using a correction quantity conforming to the remaining-toner detection output value, with regard to six intervals of output values, namely an interval of output values from 1.5 V, which corresponds to an amount of remaining toner of 100%, to 1.55 V, which corresponds to an amount of remaining toner of 75%; an interval of output values from 1.55 V to 1.65 V corresponding similarly to an interval of 75% to 50%; an interval of output values from 1.65 V to 1.9 V corresponding to an interval of 50% to 25%; and, in order to maintain accuracy even for an amount of toner below 25%, an interval of output values from 1.9 V to 2.2 V corresponding to an interval of 25% to 15%, an interval of output values from 2.2 V to 2.55 V corresponding to an interval of 15% to 5%, and an interval of output values from 2.55 V to 2.75 V corresponding to an interval of 5% to 0%.

Further, with regard to the changeover of the correction value, consider a correction in the interval from 75% to 50% by way of example. At the moment the remaining-toner detection output value becomes 1.55 V, a correction is applied to the remaining-toner detection output value using the correction value (0.48) for the interval of 75% to 50%. A similar changeover timing is adopted with regard to other intervals.

Figure 9:
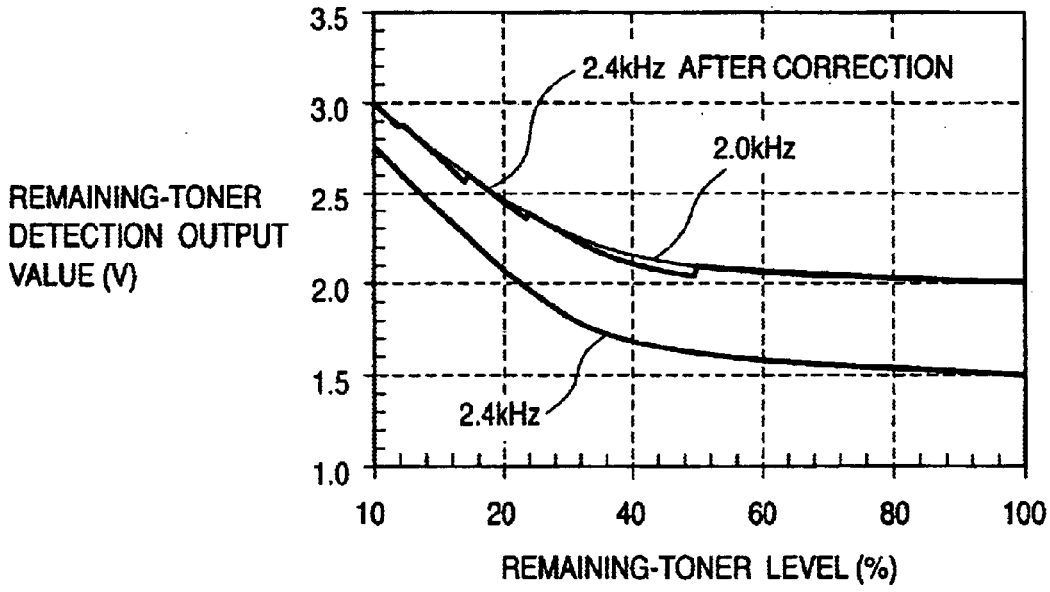
FIG. 9 is a diagram useful in describing correction of output values obtained in sensing amount of remaining toner corresponding to a second embodiment of the present invention.

As a result, the relationship between the remaining-toner detection output value after correction and the actual amount of remaining toner becomes as shown in FIG. 9. If the remaining-toner level is decided based upon the remaining-toner detection output value after correction shown in FIG. 9, the remaining-toner level rises because the remaining-toner detection output value after correction decreases immediately after the correction quantity is changed over. This is ascribable to the fact that the correction quantity before the changeover differs from that after the changeover. For example, whereas the correction quantity is 0.50 V when the output value is 1.54 V, the correction quantity becomes 0.48 V when the output value is 1.55 V. Consequently, the remaining-toner detection output value after correction decreases from 2.04 V to 2.03 V.

Thus, the remaining-toner level rises. Therefore, the remaining-toner level stored in the memory unit 25 and storage device 39*b* already described in the first embodiment is made irreversible, the stored value is not overwritten by the input value in a case where the input value is greater than the already stored remaining-toner level, and the stored value is updated only in a case where a value smaller than the stored value is applied. This makes it possible to eliminate the reversal phenomenon of the remaining-toner level before and after the changeover.

The foregoing makes it possible to obtain the results shown in Table 4 below. Table 4 indicates the actual remaining-toner levels, as well as the remaining-toner levels after correction in an instance where the frequency of developing bias has been set to 2.4 kHz, in a case where remaining-toner levels reported to the user are 75%, 50%, 25% and 0% when frequency of developing bias is set to either of two values, namely 2.0 and 2.4 kHz.

TABLE 4

| | 75% | 50% | 25% | 15% | 5% | 0% | |
|---|---|---|---|---|---|---|---|
| 2.0 kHz | 75 | 50 | 25 | 15 | 5 | 0 | |
| 2.4 kHz | 22 | 19 | 11 | 5 | — | — | |
| AFTER CORRECTION | 79 | 51 | 26 | 16 | 6 | 0 | (%) |

Thus, it will be understood that by performing an optimum correction in each interval in accordance with the amount of remaining toner in this embodiment, the suitability of the graphs is enhanced and so is the accuracy with which the amount of remaining toner is sensed.

The operation of this embodiment will now be described. Overall processing is similar to that of the first embodiment and this embodiment operates in accordance with the flowchart of FIG. 15. In this embodiment, however, the processing for correcting the remaining-toner detection output signal at step S1513 is executed in accordance with the flowchart of FIG. 16.

Figure 16:
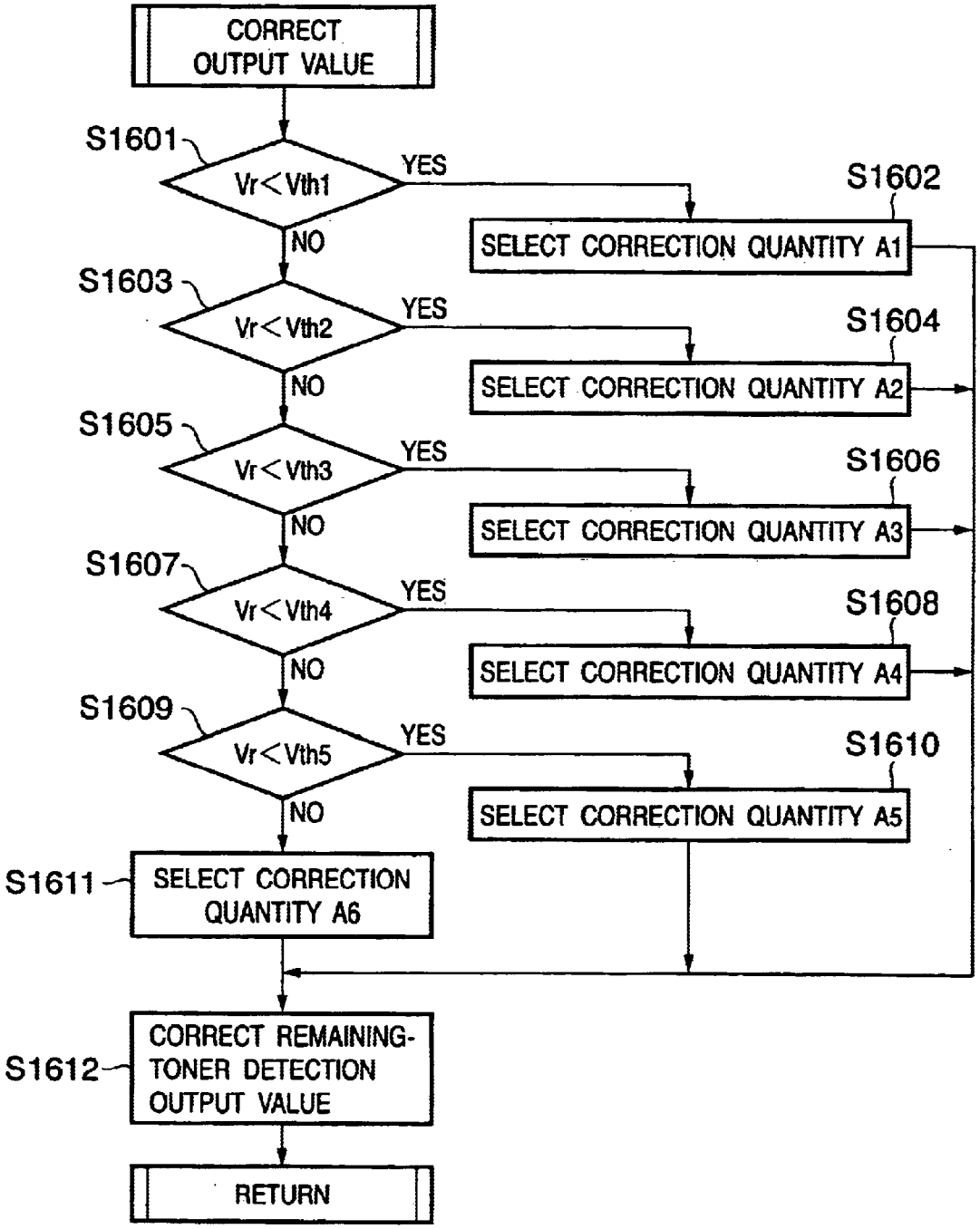
FIG. 16 is a flowchart relating to processing for correcting output values obtained in sensing amount of remaining toner corresponding to the second embodiment of the present invention.

In FIG. 16, the remaining-toner detection output value is represented by Vr. Further, Vth1 to Vth5 correspond to respective ones of the voltage values that decide the range of remaining-toner detection output values in Table 3. Specifically, Vth1, Vth2, Vth3, Vth4 and Vth5 are 1.55 V, 1.65 V, 1.90 V, 2.2 V and 2.55 V, respectively.

Further, correction values A1 to A6 in FIG. 16 similarly correspond to respective ones of the correction quantities in Table 3, i.e., A1, A2, A3, A4, A5 and A6 are 0.50 V, 0.48 V, 0.42 V, 0.36 V, 0.30 V and 0.25 V, respectively.

Of course, such assignment of threshold values and correction quantities is for the purpose of describing this embodiment and does not impose any limitation upon the invention. It goes without saying that the method of setting threshold values and correction quantities can be selected freely in accordance with the operating conditions of the image forming apparatus.

The details of output-value correction processing corresponding to FIG. 16 will now be described. First, at step S1601 in FIG. 16, it is determined whether the remaining-toner detection output value Vr is less than Vth1, i.e., whether the amount of remaining toner falls within the range of 100% to 75%. If the determination is that Vr is less than Vth1, it can be decided that the amount of remaining toner falls within the above range and, hence, A1 is selected at step S1602 as the correction quantity used in processing for correcting the remaining-toner detection output value.

Next, if it has been determined at step S1601 that Vr is equal to or greater than Vth1, control proceeds to step S1603, at which it is determined whether Vr is less than Vth2, i.e., whether the amount of remaining toner falls within the range of 75% to 50%. If the determination is that Vr is less than Vth2, it can be decided that the amount of remaining toner falls within the above range and, hence, A2 is selected at step S1604 as the correction quantity used in processing for correcting the remaining-toner detection output value.

Next, if it has been determined at step S1603 that Vr is equal to or greater than Vth2, control proceeds to step S1605, at which it is determined whether Vr is less than Vth3, i.e., whether the amount of remaining toner falls within the range of 50% to 25%. If the determination is that Vr is less than Vth3, it can be decided that the amount of remaining toner falls within the above range and, hence, A3 is selected at step S1606 as the correction quantity used in processing for correcting the remaining-toner detection output value.

Next, if it has been determined at step S1605 that Vr is equal to or greater than Vth3, control proceeds to step S1607, at which it is determined whether Vr is less than Vth4, i.e., whether the amount of remaining toner falls within the range of 25% to 15%. If the determination is that Vr is less than Vth4, it can be decided that the amount of remaining toner falls within the above range and, hence, A4 is selected at step S1608 as the correction quantity used in processing for correcting the remaining-toner detection output value.

Next, if it has been determined at step S1607 that Vr is equal to or greater than Vth4, control proceeds to step S1609, at which it is determined whether Vr is less than Vth5, i.e., whether the amount of remaining toner falls within the range of 15% to 5%. If the determination is that Vr is less than Vth5, it can be decided that the amount of remaining toner falls within the above range and, hence, A5 is selected at step S1610 as the correction quantity used in processing for correcting the remaining-toner detection output value.

Next, if it has been determined at step S1609 that Vr is equal to or greater than Vth5, it can be decided that the amount of remaining toner falls within the range of 5% to 0%. Hence, A6 is selected at step S1611 as the correction quantity used in processing for correcting the remaining-toner detection output value.

Thus, since any of A1 to A6 is selected as the correction quantity through the above-mentioned steps, processing for correcting the remaining-toner detection output value is executed at step S1612 using the correction quantity selected.

Thus, in this embodiment, in an arrangement in which the frequency of developing bias is changed depending upon the type of printing medium and a correction is applied to a remaining-toner detection output value in accordance with the frequency, it is possible to achieve greater accuracy by changing the correction quantity in dependence upon amount of remaining toner.

Further, in the description of the correction according to this embodiment, a method of sensing amount of remaining toner upon dividing the amount of remaining toner into six ranges is described. However, there is no limitation upon the method of partitioning the amount of remaining toner. For example, it is possible to broaden partitioning to eight or ten intervals that are further subdivided, whereby a correction curve can eventually be obtained so that a correction conforming to amount of remaining toner may be set much more finely. This will make possible a further improvement in accuracy.

[Third Embodiment]

According to the first and second embodiments set forth above, the plate antenna PA for sensing amount of remaining toner is a single antenna. However, to deal with an increase in the capacity of the toner cartridge, it is possible to adopt an arrangement having a plurality of plate antennas for sensing amount of remaining toner. Further, in the case of this arrangement having the plurality of plate antennas, it is possible to adopt an arrangement in which the range over which the amount of remaining toner is measured differs for each antenna. For example, the measurement range can be divided up into a range for a plate antenna that measures amount of remaining toner highly accurately from an amount of 100% to an amount of 50%, and a range for a plate antenna that measures amount of remaining toner highly accurately from an amount of 50% to an amount of 0%.

Furthermore, in order to divide up the measurement range, one plate antenna may be placed at a location where the first half of the amount of remaining toner will be determined and the other plate antenna may be placed at a location where the second half of the amount of remaining toner will be determined.

However, if a plurality of plate antennas are thus provided, the electrostatic capacity will differ for each. Accordingly, in a case where the frequency of developing bias is changed depending upon the image forming mode, the amount of change in the remaining-toner detection output value ascribable to the change in frequency of developing bias will differ for each antenna and it will be necessary to change the correction quantity depending upon each plate antenna.

According to this embodiment, therefore, processing for correcting the remaining-toner detection output value that applies the single-plate-antenna arrangement of the first and second embodiments is expanded to deal with a cartridge having a plurality of plate antennas. More specifically, the developing unit is equipped with a plurality of electrodes that include at least first and second electrodes, the apparatus senses induced voltages, which correspond to amount of remaining toner in the developing unit, induced by the first and second electrodes owing to a developing bias having a prescribed frequency among frequencies of developing bias, the induced voltages are corrected utilizing each of correction quantities for which a reference induced voltage, which is sensed in conformity with amount of remaining toner in a case where developing bias has been applied at a reference frequency, is obtained as a reference, and amount of remaining toner is decided based upon each of the corrected induced voltages.

Figure 10:
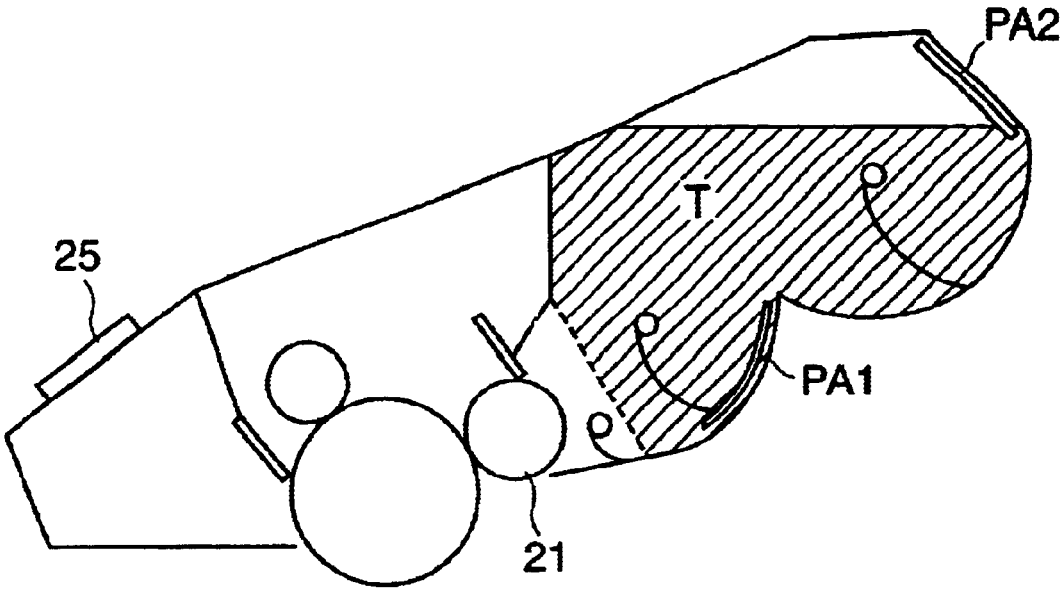
FIG. 10 is a diagram illustrating an example of the cross section of a toner cartridge corresponding to a third embodiment of the present invention.

According to this embodiment, as shown in FIG. 10, plate antennas (PA1, PA2) are disposed inside the toner container along with the developing sleeve 21 so as to form a capacitor structure as means for sensing amount of remaining toner, and the toner is accommodated by the developing sleeve 21 and plate antennas (PA1, PA2).

The method of placing these plate electrodes and the electrical connections are similar to those of the first embodiment and need not be described again in detail. The sensing of amount of remaining toner by the developing sleeve 21 and plate antennas (PA1, PA2) is performed by measuring the remaining-toner detection output value using the developing bias that is applied to the developing sleeve 21.

Figure 11:
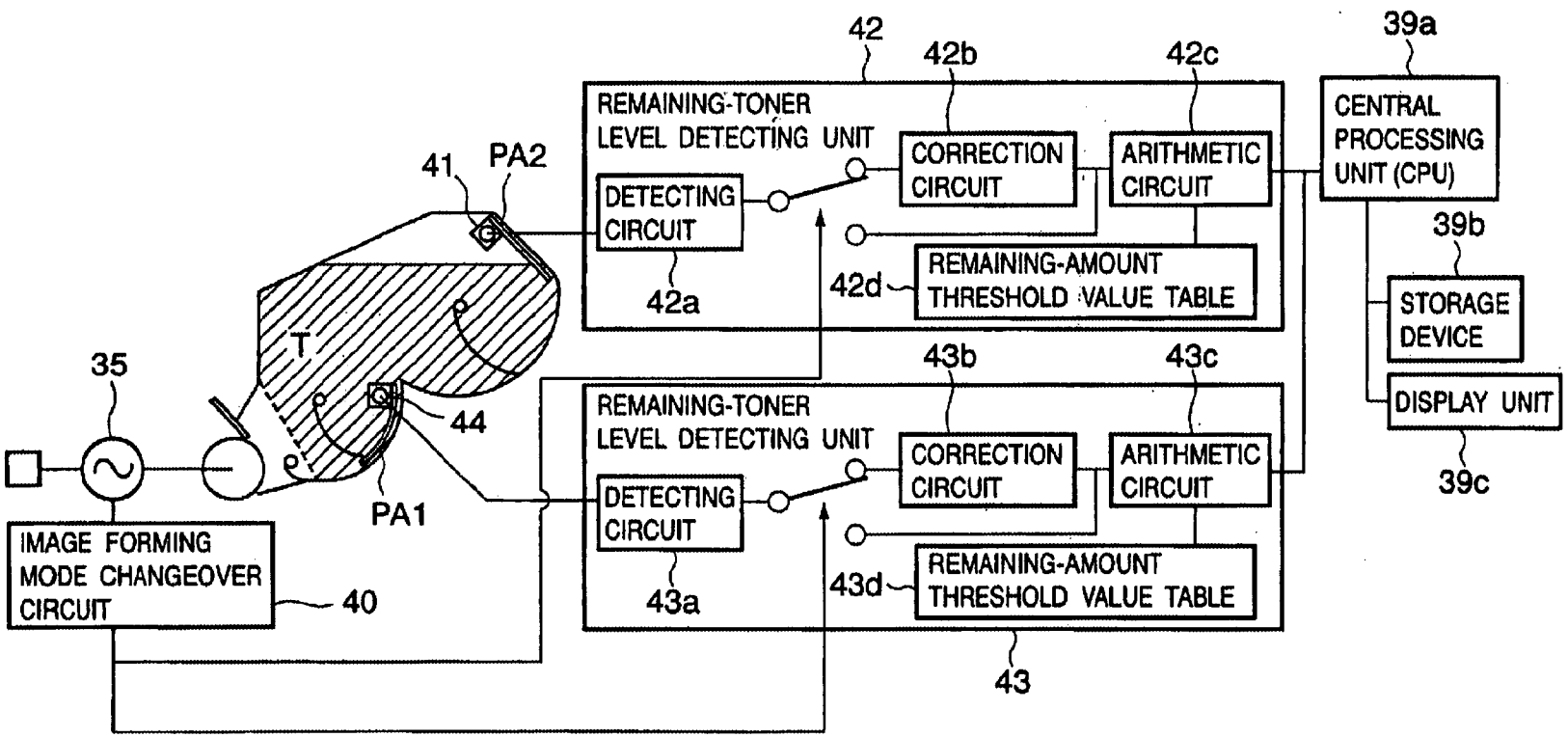
FIG. 11 is a diagram illustrating an example of the cross section of a developer container within a toner cartridge corresponding to the third embodiment of the present invention.

Further, according to this embodiment, remaining-toner detection outputs obtained by two plate antennas (PA1, PA2) as shown in FIG. 11 are processed by respective ones of corresponding remaining-toner sensors 42, 43.

A voltage value produced by the plate antenna PA2 is output from an electrode 41 to the remaining-toner sensor 42, which is a circuit dedicated to PA2, disposed on the apparatus body, the voltage value is digitally converted by a detecting circuit 42*a* and the digital signal is output as a remaining-toner detection output value. In accordance with the output of the circuit 40 for changing over the image forming mode, the remaining-toner detection output value is input to an arithmetic circuit 42*c* after being corrected in a correction circuit 42*b* or is input to the arithmetic circuit 42*c* directly upon bypassing the correction circuit 38*b*. The arithmetic circuit 42*c* compares the corrected or uncorrected remaining-toner detection output value input thereto with a threshold value that has been stored in a remaining-amount threshold value table 42*d*, decides the remaining-toner level and transmits the decided remaining-toner level to the CPU 39*a*. The operation of the plate antenna PA1 is similar to that of the plate antenna PA2.

According to this embodiment, the output obtained using the plate antenna PA2 that is farther from the developing sleeve 21 than the plate antenna PA1 is used to sense the first half of the amount of remaining toner (i.e., from 100% to 50%), and the output obtained using the plate antenna PA1 that is closer to the developing sleeve 21 is used to sense the second half of the amount of remaining toner (i.e., from 50% to 0%).

Furthermore, the condition settings used in sensing the remaining-toner level in this embodiment also are similar to those adopted in the first embodiment. In addition, with regard to the two remaining-toner sensing circuits, the placement conditions of the plate antenna PA1 that is near the developing sleeve are adjusted in this embodiment such that the electrostatic capacity will be 2 pF in the absence of toner and 6 pF when the cartridge is full of toner. Similarly, the placement conditions of the plate antenna PA2 that is far from the developing sleeve are adjusted in this embodiment such that the electrostatic capacity will be 3 pF in the absence of toner and 1 pF when the cartridge is full of toner. It should be noted that these settings are solely for the purpose of describing this embodiment and are not intended to limit the invention of this application to an invention that operates under the conditions of these settings. Further, settings other than those mentioned above can be applied to the present invention.

Further, the remaining-toner sensors 42, 43 are each so adapted that when the frequency of developing bias is 2.0 kHz, the voltage value produced by the remaining-toner sensing circuit will be 3 V at each plate antenna in the absence of toner and 2 V at each plate antenna if the cartridge is full of toner.

Figure 12:
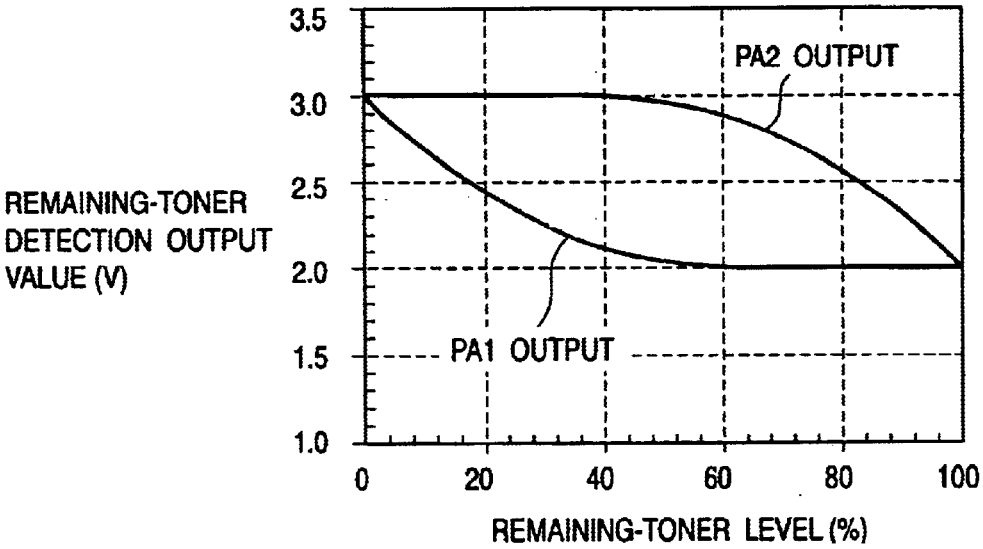
FIG. 12 is a diagram illustrating output values obtained in sensing amount of remaining toner at a frequency of developing bias of 2.0 kHz corresponding to the third embodiment of the present invention.

First, consider the change in amount of remaining toner and the change in the remaining-toner detection output value for the plate antenna PA1 and plate antenna PA2 at 2.0 kHz. The situation is illustrated in FIG. 12. Here PA2 represents the first half of the amount of remaining toner in the toner cartridge and PA1 represents the second half of the amount of remaining toner in the toner cartridge.

Figure 13:
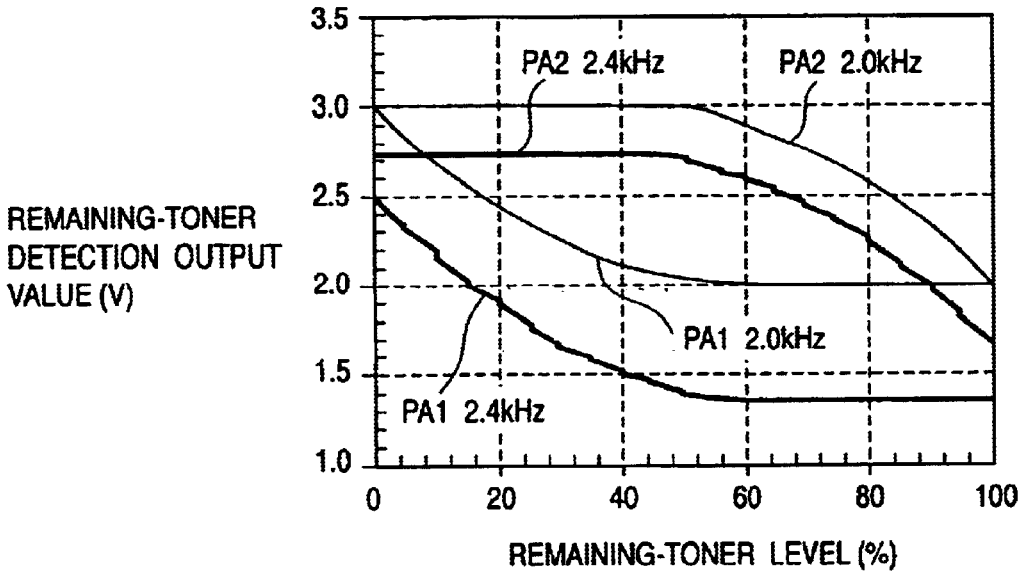
FIG. 13 is a diagram illustrating output values obtained in sensing amount of remaining toner at frequencies of developing bias of 2.0 kHz and 2.4 kHz corresponding to the third embodiment of the present invention.

Next, if the frequency of developing bias is changed from 2.0 to 2.4 kHz and the changes in the outputs of the remaining-toner sensors are similarly observed, the result is as shown in FIG. 13. Here it will be understood that changing the frequency of developing bias from 2.0 to 2.4 kHz produces a change in the outputs obtained by the plate antennas PA1 and PA2. Furthermore, if the difference in voltages between 2.0 kHz and 2.4 kHz is observed, it will be understood that the value is about 0.6 V for plate antenna PA1 and about 0.3 V for plate antenna PA2, meaning that the amount of change for plate antenna PA1 is different from the amount of change for plate antenna PA2.

Accordingly, it is evident that if a correction quantity that is optimum for either plate antenna PA1 or PA2 is applied to the other, an actual deviation will be produced in the remaining-toner level associated with this other plate antenna. Accordingly, the correction of remaining-toner detection output values is performed using correction quantities that are optimum for respective ones of the plate antennas PA1 and PA2.

Figure 14:
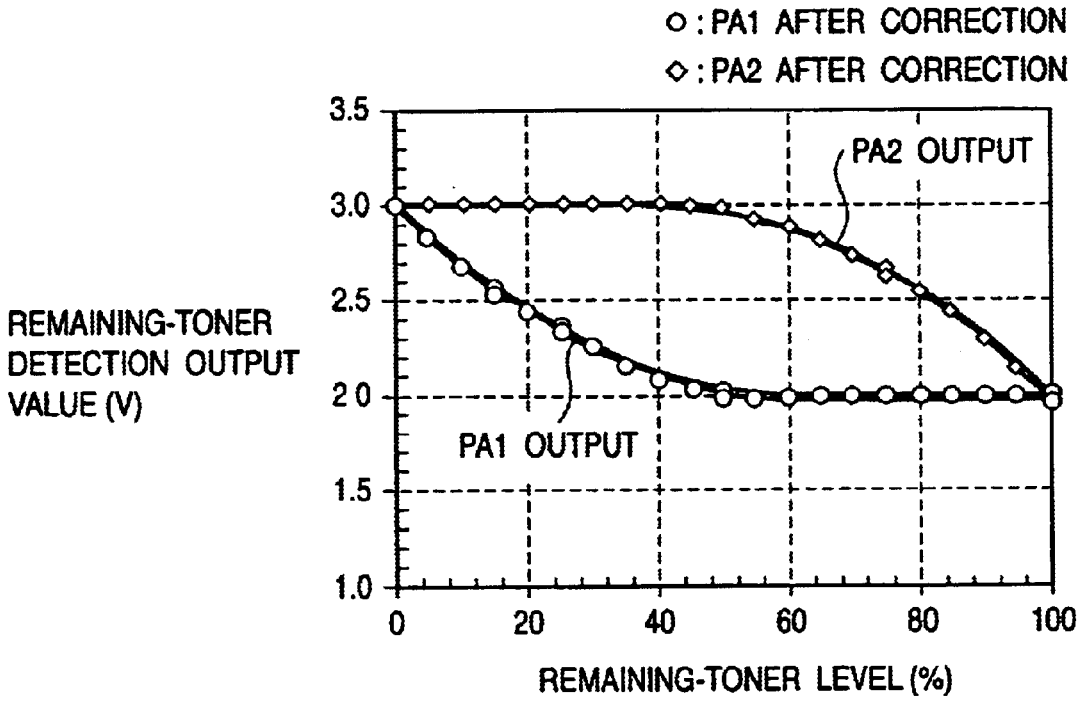
FIG. 14 is a diagram useful in describing correction of output values obtained in sensing amount of remaining toner corresponding to the third embodiment of the present invention.

As shown in Table 5 below, therefore, a correction quantity conforming to the remaining-toner level is set with regard to each of the plate antennas PA1 and PA2. Table 5 indicates remaining-toner detection output values regarding respective ones of the plate antennas PA1, PA2 as well as correction quantities of these remaining-toner detection output values corresponding to remaining-toner levels of from 100% to 75%, 75% to 50%, 50% to 25%, 25% to 15%, 15% to 5% and 5% to 0%. The result of correcting the remaining-toner detection output values using the correction quantities indicated in Table 5 is as depicted in FIG. 14. Here transitions in which the remaining-toner detection output values and amounts of remaining toner substantially coincide can be obtained even in a case where the frequency of developing bias is changed from 2.0 to 2.4 kHz.

TABLE 5

| AT 2.4 kHz | 100~75 | 75~50 | 50~25 | 25~15 | 15~5 | 5~0 | (%) |
|---|---|---|---|---|---|---|---|
| PA1 | | | | | | | |
| Vr1 | 1.33 | 1.40~1.34 | 1.79~1.40 | 2.05~1.79 | 2.35~2.05 | 2.52~2.35 | (V) |
| A1n | 0.65 | 0.62 | 0.57 | 0.54 | 0.51 | 0.5 | (V) |
| PA2 | | | | | | | |
| Vr2 | 2.35~1.67 | 2.70~2.35 | 2.72~2.70 | 2.72 | 2.72 | 2.72 | (V) |
| A2n | 0.31 | 0.28 | 0.27 | 0.27 | 0.27 | 0.27 | (V) |

The problem that arises owing to the fact that the correction quantities differ in the area in which the remaining-toner level is changed over is solved in a manner similar to that of the second embodiment. Specifically, the remaining-toner level stored in the memory unit 25 and storage device 39*b* is made irreversible, the stored value is not overwritten by the input value in a case where the input value is greater than the already stored remaining-toner level, and the stored value is updated only in a case where a value smaller than the stored value is applied.

The processing operation according to this embodiment will now be described. The overall processing is similar to that of the first embodiment and is executed in accordance with the flowchart of FIG. 15. In this embodiment, however, the processing for correcting the remaining-toner detection output signal at step S1513 is executed in accordance with the flowchart shown in FIGS. 17A and 17B.

Figure 17A:
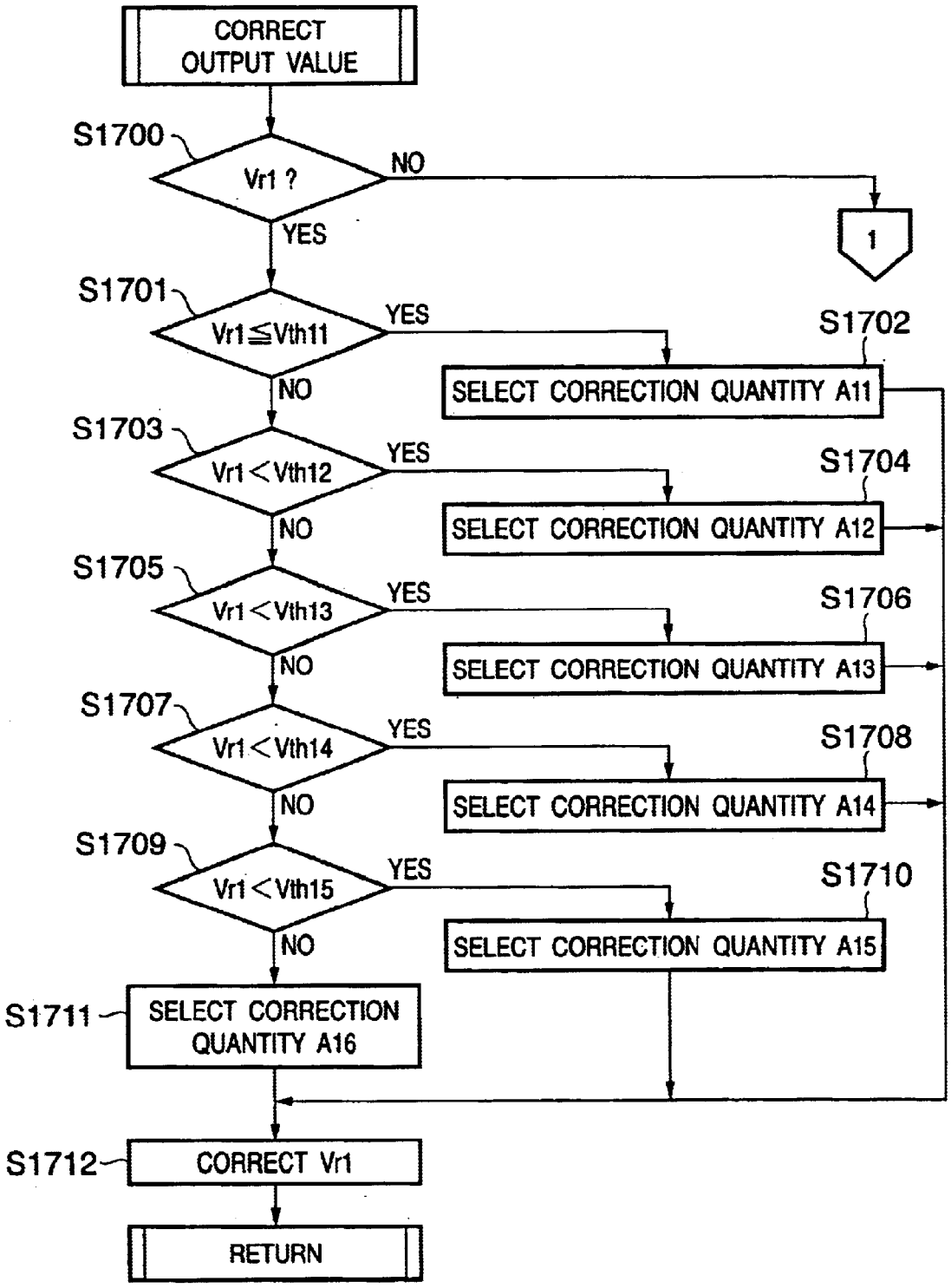
FIG. 17A is a flowchart relating to processing for correcting output values obtained in sensing amount of remaining toner corresponding to the third embodiment of the present invention.
Figure 17B:
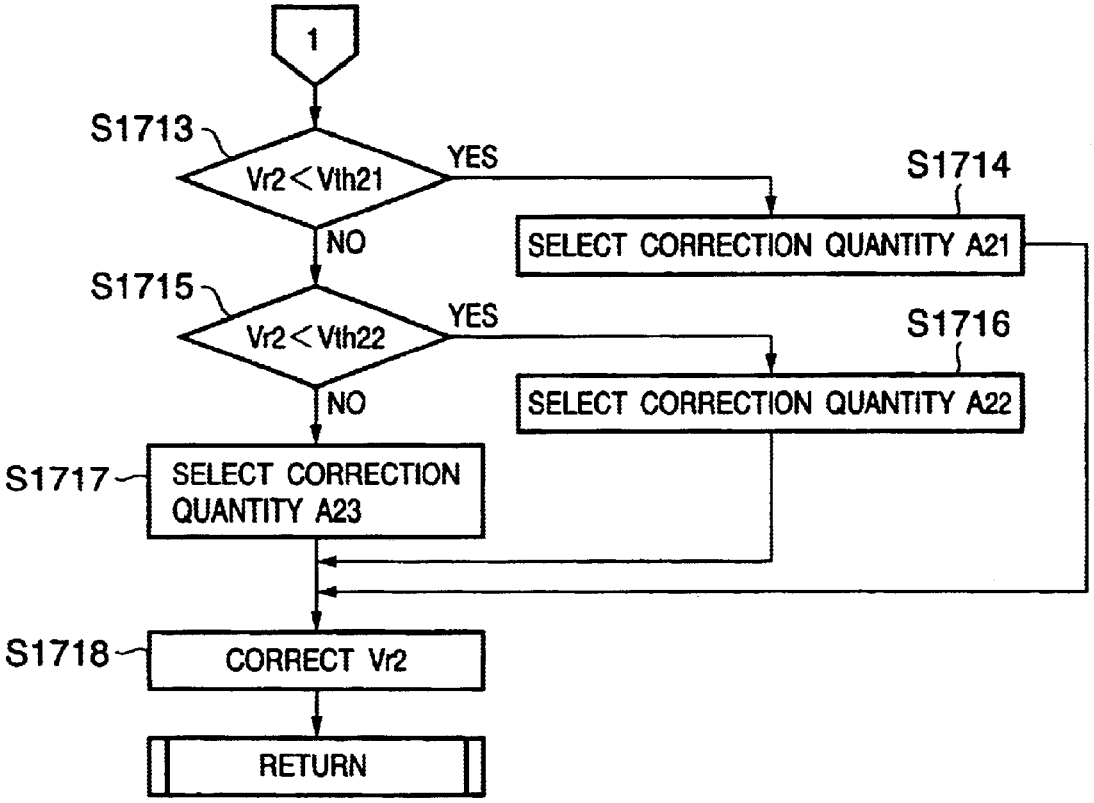
FIG. 17B is a flowchart relating to processing for correcting output values obtained in sensing amount of remaining toner corresponding to the third embodiment of the present invention.

In FIGS. 17A and 17B, remaining-toner detection output values based upon the plate antennas PA1 and PA2 are represented by Vr1 and Vr2 in conformity with Table 5. Further, Vth11 to Vth15 and Vth21, Vth22 correspond to voltage values that decide the ranges of remaining-toner detection output values of plate antennas PA1, PA2 in Table 5. More specifically, Vth11, Vth12, Vth13, Vth14 and Vth15 are 1.33 V, 1.40 V, 1.79 V, 2.05 V and 2.35 V, respectively.

Further, correction values A11 to A16 and A21 to A23 in FIGS. 17A and 17B similarly correspond to respective ones of the correction quantities of remaining-toner detection output values regarding the plate antenna PA1 and PA2 in Table 5. That is, A11, A12, A13, A14, A15 and A16 are made 0.65 V, 0.62 V, 0.57 V, 0.54 V, 0.51 V and 0.5 V, respectively. Further, A21, A22 and A23 are made 0.31 V, 0.28 V and 0.27 V, respectively.

Of course, such assignment of threshold values and correction quantities is for the purpose of describing this embodiment and does not impose any limitation upon the invention. It goes without saying that the method of setting threshold values and correction quantities can be selected freely in accordance with the operating conditions of the image forming apparatus.

The details of output-value correction processing corresponding to FIGS. 17A and 17B will now be described. First, with regard to correction of the remaining-toner detection output value concerning plate antenna PA1, it is determined at step S1701 whether the remaining-toner detection output value Vr1 is less than Vth11. If the determination is that Vr1 is less than Vth11, A11 is selected at step S1702 as the correction quantity used in processing for correcting the remaining-toner detection output value.

Next, if it has been determined at step S1701 that Vr1 is equal to or greater than Vth11, control proceeds to step S1703, at which it is determined whether Vr1 is less than Vth12, i.e., whether the amount of remaining toner is greater than 50%. If the determination is that Vr1 is less than Vth12, it can be decided that the amount of remaining toner is greater than 50% and, hence, A12 is selected at step S1704 as the correction quantity used in processing for correcting the remaining-toner detection output value.

Next, if it has been determined at step S1703 that Vr1 is equal to or greater than Vth12, control proceeds to step S1705, at which it is determined whether Vr1 is less than Vth13, i.e., whether the amount of remaining toner falls within the range of 50% to 25%. If the determination is that Vr1 is less than Vth13, it can be decided that the amount of remaining toner falls within the above range and, hence, A13 is selected at step S1706 as the correction quantity used in processing for correcting the remaining-toner detection output value.

Next, if it has been determined at step S1705 that Vr1 is equal to or greater than Vth13, control proceeds to step S1707, at which it is determined whether Vr1 is less than Vth14, i.e., whether the amount of remaining toner falls within the range of 25% to 15%. If the determination is that Vr1 is less than Vth14, it can be decided that the amount of remaining toner falls within the above range and, hence, A14 is selected at step S1708 as the correction quantity used in processing for correcting the remaining-toner detection output value.

Next, if it has been determined at step S1707 that Vr1 is equal to or greater than Vth14, control proceeds to step S1709, at which it is determined whether Vr1 is less than Vth15, i.e., whether the amount of remaining toner falls within the range of 15% to 5%. If the determination is that Vr1 is less than Vth15, it can be decided that the amount of remaining toner falls within the above range and, hence, A15 is selected at step S1710 as the correction quantity used in processing for correcting the remaining-toner detection output value.

Next, if it has been determined at step S1709 that Vr1 is equal to or greater than Vth14, it can be decided that the amount of remaining toner falls within the range of 5% to 0%. Hence, A16 is selected at step S1711 as the correction quantity used in processing for correcting the remaining-toner detection output value.

Thus, since any of A1 to A6 is selected as the correction quantity through the above-mentioned steps, processing for correcting the remaining-toner detection output value Vr1 corresponding to the plate antenna PA1 is executed at step S1712 using the correction quantity selected.

Next, with regard to the plate antenna PA2, it is determined at step S1713 whether the remaining-toner detection output value Vr2 is less than Vth21, i.e., whether the amount of remaining toner falls within the range of 100% to 75%. If the determination is that Vr2 is less than Vth21, A21 is selected at step S1714 as the correction quantity used in processing for correcting the remaining-toner detection output value Vr2.

On the other hand, if it is determined that Vr2 is equal to or greater than Vr21, control proceeds to step S1715, at which it is determined whether Vr2 is less than Vth22, i.e., whether the amount of remaining toner falls within the range of 50% to 25%. If the determination is that Vr2 is less than Vth22, it can be decided that the amount of remaining toner falls within the above range and, hence, A22 is selected at step S1716 as the correction quantity used in processing for correcting the remaining-toner detection output value Vr2.

Next, if it is determined at step S1715 that Vr2 is equal to or greater than Vr22, it can be decided that the amount of remaining toner falls within the range below 25% and, hence, A23 is selected at step S1717 as the correction quantity used in processing for correcting the remaining-toner detection output value Vr2.

Thus, since any of A21 to A23 is selected as the correction quantity through the above-mentioned steps, processing for correcting the remaining-toner detection output value Vr2 corresponding to the plate antenna PA2 is executed at step S1718 using the correction quantity selected.

Thus, this embodiment is such that in an arrangement for sensing amount of remaining toner in a cartridge having a plurality of plate antennas that sense amount of remaining toner, it can be so arranged that the accuracy with which amount of remaining toner is sensed is raised by correcting a remaining-toner detection output value utilizing a correction quantity that is suitable for each plate antenna.

Further, in the description of this embodiment rendered above, an arrangement having two remaining-toner sensors provided in correspondence with two plate antennas is described. However, the number of sensors is not limited to two and a single-sensor arrangement may be adopted. In such case it would suffice to adapt the circuitry so as to apply the output of the plate antenna PA2 to the remaining-toner sensor when the remaining-toner level falls within the range of 100% to 50% and apply the output of the plate antenna PA1 to the remaining-toner sensor when the remaining-toner level falls within the range of 50% to 0%.

Furthermore, in the description of this embodiment rendered above, it is stated that an optimum correction is applied on a per-interval basis in a manner similar to that of the second embodiment in regard to correction applied to a remaining-toner detection output value. However, the intervals are not limited to the above, as described in the second embodiment. It is possible to sense the amount of remaining toner with a higher accuracy by correcting the remaining-toner detection output value upon setting finer intervals.

<Other Embodiments>

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code itself installed in the computer also implements the present invention. In other words, the claims of the present invention also cover a computer program for the purpose of implementing the functions of the present invention.

In this case, so long as the system or apparatus has the functions of the program, the program may be executed in any form, e.g., as object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

Further, it is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Furthermore, besides the case where the aforesaid functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus having a developing container for accommodating a developer and a developing member for carrying the developer and being capable of setting a plurality of frequencies of developing bias applied to the developing member, said apparatus comprising:

a sensing member for sensing amount of the developer inside the developing container; and a processing unit for obtaining the amount of developer inside the developing container based upon a detection value from said sensing member;

wherein said processing unit corrects the detection value in accordance with the frequency of the developing bias and the detection value from said sensing member, and obtains the amount of developer based upon the corrected value.

2. The apparatus according to claim 1, wherein a correction value for correcting the detection value is a value corresponding to each frequency of the frequencies of the developing bias.

3. The apparatus according to claim 1, wherein the frequency of the developing bias is set in accordance with the type of printing medium used in image formation.

4. The apparatus according to claim 1, wherein said processing unit obtains the amount of developer by detecting electrostatic capacity between the developing member and said sensing member.

5. An image forming apparatus having a developing container for accommodating a developer and a developing member for carrying the developer and being capable of setting a plurality of frequencies of developing bias applied to the developing member, said apparatus comprising:

a first sensing member for sensing amount of the developer inside the developing container; and a second sensing member for sensing amount of the developer inside the developing container; and a processing unit for obtaining the amount of developer inside the developing container based upon the frequency of the developing bias and a first detection value from said first sensing member or a second detection value from said second sensing member.

6. The apparatus according to claim 5, wherein said processing unit corrects the first detection value and the second correction value in accordance with the frequency of the developing bias, and obtains the amount of developer based upon the corrected values.

7. The apparatus according to claim 6, wherein a correction value for correcting the detection values is a value corresponding to each frequency of the frequencies of the developing bias.

8. The apparatus according to claim 5, wherein said processing unit corrects the first detection value or the second detection value in accordance with the frequency of the developing bias and the first detection value or the second detection value.

9. The apparatus according to claim 5, wherein the frequency of the developing bias is set in accordance with the type of printing medium used in image formation.

10. The apparatus according to claim 5, wherein said processing unit obtains the amount of developer by detecting electrostatic capacity between the developing member and said first sensing member or said second sensing member.

11. A method of sensing amount of developer in an image forming apparatus having a developing container for accommodating a developer and a developing member for carrying the developer and being capable of setting a plurality of frequencies of developing bias applied to the developing member, said method comprising the steps of:

sensing a detection value from a sensing member for sensing amount of the developer inside the developing container;

correcting the detection value in accordance with the frequency of the developing bias and the detection value; and obtaining the amount of developer inside the developing container based upon the corrected value.

12. The method according to claim 11, further comprising a step of changing over the correction value for correcting the detection value.

13. A method of sensing amount of developer in an image forming apparatus having a developing container for accommodating a developer and a developing member for carrying the developer and being capable of setting a plurality of frequencies of developing bias applied to the developing member, said method comprising the steps of:

sensing a first detection value from a first sensing member for sensing amount of the developer inside the developing container;

sensing a second detection value from a second sensing member for sensing amount of the developer inside the developing container; and obtaining the amount of developer inside the developing container based upon the frequency of the developing bias and the first detection value or the second detection value.

14. The method according to claim 12, further comprising a step of correcting the first detection value or the second detection value in accordance with the developing bias.

15. The method according to claim 13, further comprising a step of changing over the correction value for correcting the first detection value or the second detection value in accordance with the first detection value or the second detection value.

16. An image forming apparatus having a developing container for accommodating a developer and a developing member for carrying the developer and being capable of setting a plurality of frequencies of developing bias applied to the developing member in accordance with the type of a printing medium used in image formation, said apparatus comprising:

a sensing member for sensing amount of the developer inside the developing container; and a processing unit for obtaining the amount of developer inside the developing container based upon a detection value from said sensing member;

wherein said processing unit corrects the detection value in accordance with the frequency of the developing bias, and obtains the amount of developer based upon the corrected value.

17. The apparatus according to claim 16, wherein a correction value for correcting the detection value is a value corresponding to each frequency of the frequencies of the developing bias.

18. The apparatus according to claim 16, wherein said processing unit obtains the amount of developer by detecting electrostatic capacity between the developing member and said sensing member.

19. A method of sensing amount of developer in an image forming apparatus having a developing container for accommodating a developer and a developing member for carrying the developer and being capable of setting a plurality of frequencies of developing bias applied to the developing member in accordance with the type of a printing medium used in image formation, said method comprising the steps of:

sensing a detection value from a sensing member for sensing amount of the developer inside the developing container;

correcting the detection value in accordance with the frequency of the developing bias; and obtaining the amount of developer inside the developing container based upon the corrected value.

* * * * *

UNITED STATES PATENT AND TRADEMARK OFFICE

CERTIFICATE OF CORRECTION

PATENT NO. : 6,944,410 B2
APPLICATION NO. : 10/701451
DATED : September 13, 2005
INVENTOR(S) : Naito et al.

It is certified that error appears in the above-identified patent and that said Letters Patent is hereby corrected as shown below:

On the title page,

[*] Notice: Subject to any disclaimer, the term of this patent is extended or adjusted under 35 USC 154(b) by (0) days Delete the phrase "by 0" and insert -- by 62 days--

Signed and Sealed this

Twelfth Day of June, 2007

JON W. DUDAS
*Director of the United States Patent and Trademark Office*